US005192861A

United States Patent [19]

Breskin et al.

[11] Patent Number: 5,192,861

[45] Date of Patent: Mar. 9, 1993

[54] X-RAY IMAGING DETECTOR WITH A GASEOUS ELECTRON MULTIPLIER

[75] Inventors: Amox Breskin, Rehovot; Rachel Chechik, Bet Hanan, both of Israel; Stanislaw Majewski, Grafton, Va.

[73] Assignee: Yeda Research & Development Co. Ltd., Rehovot, Israel

[21] Appl. No.: 675,652

[22] Filed: Mar. 27, 1991

[30] Foreign Application Priority Data

Apr. 1, 1990 [IL] Israel ..... 93969

[51] Int. Cl.[5] ..... H01J 31/50; H01J 40/14; H01J 43/20

[52] U.S. Cl. ..... 250/214 VT; 250/385.1; 250/374; 313/534; 313/105 C

[58] Field of Search ..... 250/213 VT, 207, 370.09, 250/385.1, 374; 313/532, 533-536, 538, 105 CM

[56] References Cited

U.S. PATENT DOCUMENTS

| | | | |
|---|---|---|---|
| 3,710,125 | 1/1973 | Jacobs et al. | 250/213 VT |
| 3,935,455 | 1/1976 | Van der Bogaert | 250/324 |
| 4,346,326 | 8/1982 | Driard et al. | 250/213 VT |
| 4,376,892 | 3/1983 | Charpak et al. . | |
| 4,395,636 | 7/1983 | Anger et al. | 250/369 |
| 4,870,265 | 9/1989 | Asmussen et al. | 250/211 R |
| 4,999,500 | 3/1991 | Breskin et al. | 250/385.1 |

OTHER PUBLICATIONS

Bateman J. E. Detectors for condensed matter studies, Nucl. Instrum. Methods. a273,721-730, 1988.

Sims M. R., Peacock A. and Taylor B. G. The gas scintillation counter, Nucl. Instrum. Methods, 221, 168-174, 1984.

Arndt U. W. J. Appl. Cryst., 19, 145, 1986.

Farugi A. R. Nucl. Instrum. Methods, A273, 754, 1988.

Baru S. E. et al. Multiwire proportional chamber for a digital radiographic installation, Nucl. Instrum. Methods in Phys. Res., A283, 431-435, 1989.

Breskin A. et al. on the low pressure operation of multistep avalanche chambers, Nucl. Instrum. Methods, 220, 349, 1984.

Breskin A. and Chechik R. Detection of single electrons and low ionization with low pressure multistep chambers, IEEE Transactions on Nucl. Sci., NS-32, 504, 1985.

Chechik R. and Breskin A. on the properties of low pressure TMAE-filled UV photon detectors, Nucl. Instrum. Methods, A264, 273, 1988.

Breskin A. et al. A highly efficient low pressure UV--rich detector with optical avalanche recording, Nucl. Instrum. Methods, A273, 798, 1988.

Fischer P. et al. Pad readout for gas detectors using 128-channel integrated preamplifiers, IEEE Transactions on Nucl. Sci. NS-35, 432, 1988.

Breskin A. et al. In beam preformance of a low pressure UV-rich detector, IEEE Transactions on Nucl. Sci., NS-35, 404, 1988.

Breskin A. et al. Primery Ionization cluster counting with low pressure multistep detectors, IEEE Transactions on Nucl. Sci., NS-36, 316, 1989.

Majewski S. et al. Low pressure ultraviolet photon detector with TMAE gas photocathode, Nucl. Instrum. Methods, A264, 235, 1988.

Dagendorf V. et al. AN X-ray imaging scintillation detector with Cs-I wire chamber UV-photon readouts, WIS preprint 89-81, Proc. of the SPIE Conference on Instrumentation in Astronomy, Tucson, 1990.

Radeka V. and Boie R. A. Nucl. Instrum. Methods, 178, 543, 1980.

(List continued on next page.)

*Primary Examiner*—David C. Nelms
*Assistant Examiner*—Michael Messinger
*Attorney, Agent, or Firm*—Ladas & Parry

[57] ABSTRACT

An X-ray detector including a photocathode arranged to receive X-ray radiation and being operative to provide in response thereto an output of electrons, and at least one electron multiplier operative at subatmospheric pressure and in response to the output of electrons from the photocathode to provide an avalanche including an increased number of electrons.

21 Claims, 19 Drawing Sheets

OTHER PUBLICATIONS

Sauvage D., Breskin A. and Chechik R. A. systematic study of the emission of the light from electron avalanches in low pressure TEA and TMAE gas mixtures, Nucl. Instrum. Methods, A275, 351, 1989.

Breskin A. et al. A three stage gated UV photon gaseous detector with optical imaging, Nucl. Instrum, Methods, A286, 251, 1990.

Comby G. et al. Nucl. Instrum. Methods, A273, 165-172, 1986.

Chianelli C. et al. Nucl. Instrum. Methods, A273, 245-256, 1988.

Kowalski M. P. et al. Quantum efficiency of Cesium Iodide photocathodes at soft X-ray and extrene UV wavelengths, Appl. Optics, 25(14), 2440-2446, 1986.

Dorion I. and Ruscev M. A novel unidimensional positron sensitive multiwire detector, IEEE Transactions on Nucl. Sci., NS-34(1), 442-448, 1987.

V. Dangendorf et al, "An X-Ray Imaging Gas Scintillation . . . ", SPIE vol. 1235, Instrumentation in Astronomy VII, 1990, pp. 896-910.

A. Breskin et al, "High Accuracy Imaging . . . ", Nuclear Instr. and Methods in Physics Research, 227, 1984, Amsterdam, pp. 24-28.

R. Bellazini et al, "High Resolution Digital Autoradiography . . . ", Nuclear Instruments and Methods in Physics Research, Sec. A, vol. A251, No. 1, Oct. 1986, Amsterdam, pp. 196-198.

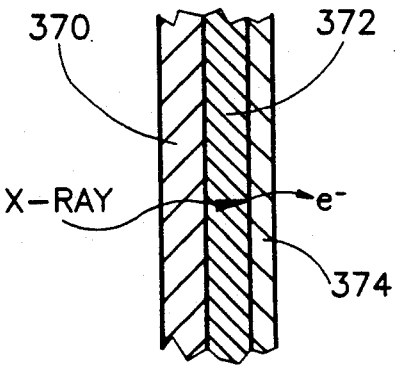
FIG.6F
FIG.6G
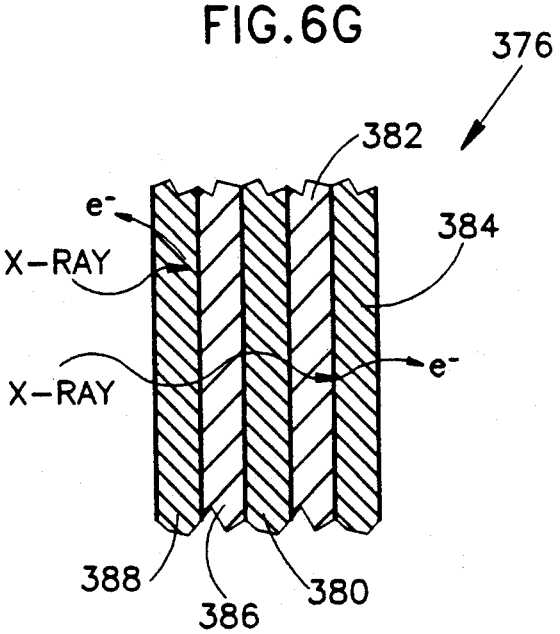

X-RAY IMAGING DETECTOR WITH A GASEOUS ELECTRON MULTIPLIER

FIELD OF THE INVENTION

The present invention relates to detectors generally and more particularly to X-ray detectors.

BACKGROUND OF THE INVENTION

Various types of X-ray detectors are known, including varieties of gas-filled imaging detectors which are based on the conversion of X-ray photons in the gas volume to electrons and on the proportional amplification of the released photoelectrons in various wire electrode assemblies. Such detectors are described by J. E. Bateman in "Detectors for Condensed Matter Studies", Nuclear Instruments and Methods, A273 (1988) 721–730. Bateman also describes other X-ray photon detectors such as various solid scintillators and semiconductor devices.

There are also known gas scintillation detectors of various types as described by M. R. Sims, A. Peacock and B. G. Taylor, "The Gas Scintillation Proportional Counter", Nuclear Instruments and Methods, 221 (1984) 168–174. Various X-ray photon detectors are also described in U. W. Arndt, J. Appl. Cryst. 19 (1986) 145.

Gas-filled detectors are by far the most efficient and flexible X-ray detectors. They offer high localization resolution and good linearity, moderate-to-high counting rate capability, and a large variety of geometries over large active areas. However, gaseous (gas filled) detectors have the following disadvantages:

1. The X-ray to electron conversion in the gas causes a geometrical parallax error for photons impinging at an angular incidence.

2. The localization accuracy is limited, due to the relatively large range of photoelectron motion in the gas.

3. Space charge effects limit the counting rate.

4. The gas multiplication process in proportional detectors and the light production in gas scintillation detectors are relatively slow processes which limit the time resolution to between tens of nanoseconds and tens of microseconds.

5. A gas medium is not an efficient converter of energetic photons in the energy range of above about 10 KeV, even for high - Z Xenon gas.

Detectors having a relatively rapid response capable of operating at high X-ray flux are important in applications such as X-ray diffraction analysis in synchrotron radiation accelerators and X-ray radiography with intense X-ray generators. Fast detectors are also important when time correlated information is needed, as in the study of dynamic processes, as described in A. R. Faruqi, Nuclear Instruments and Methods, A273 (1988) 754.

Efficiency of X-ray detectors is exceedingly important, since any increase in efficiency enables X-ray dosages applied to subjects in therapeutic and diagnostic applications to be correspondingly reduced.

A state of the art X-ray detector for medical applications is described in Baru, S. E. et al, "Multiwire proportional chamber for a digital radiographic installation", Nuclear Instruments and Methods in Physics Research A283 (1989), pp. 431–435, the disclosure of which is incorporated herein by reference.

An X-ray detector for high flux operation is described in "A Novel Unidimensional Position Sensitive Multiwire Detector" by I. Dorion and M. Ruscev, IEEE Transactions on Nuclear Science, Vol. NS-34, No. 1, February 1987, pp. 442–448.

The inventors have published papers on imaging of photoelectrons using avalanche chambers including the following:

"High Accuracy Imaging of Single Photoelectrons by Low-Pressure Multistep Avalanche Chamber Coupled to a Solid Photocathode" by A. Breskin and R. Chechik, Nuclear Instruments and Methods in Physics Research 227, (1984) 24–28.

A. Breskin et al., "On the low pressure operation of multistep avalanche chambers" Nucl. Instrum. Methods, 220 349 (1984).

A. Breskin and R. Chechik, "Detection of single electrons and low ionization with low-pressure multistep chambers" IEEE Trans. Nucl. Sci. NS-32, 504 (1985).

R. Chechik and A. Breskin, "On the properties of low-pressure, TMAE-filled UV-photon detectors" Nucl. Instrum. Methods A264, 237 (1988).

A. Breskin et al., "A highly efficient low-pressure UV-RICH detector with optical avalanche recording" Nucl. Instrum. Methods, A273 (1988) 798.

P. Fischer et al., "Pad readout for gas detectors using 128-channel integrated preamplifiers" IEEE Trans. Nucl. Sci. NS-35, (1988) 432.

A. Breskin et al., "In beam performance of a low-pressure UV-RICH detector" IEEE Trans. Nucl. Sci., NS-35, (1988) 404.

A. Breskin et al., "Primary ionization cluster counting with low-pressure multistep detectors", IEEE Trans. Nucl. Sci., NS-36 (1989) 316.

S. Majewski et al., "Low-pressure Ultraviolet Photon Detector with TMAE Gas Photocathode", Nucl. Instrum. Methods, A264 (1988) 235.

V. Dangendorf et al., "An X-ray Imaging Scintillation Detector With Cs-I Wire Chamber UV-Photon Readout", WIS preprint 89-81 December-PH. Proceedings of the SPIE Conference on Instrumentation in Astronomy, Tucson, Feb. 1990.

The disclosures of these publications and of the reference cited therein are incorporated herein by reference.

SUMMARY OF THE INVENTION

The present invention seeks to provide an improved X-ray detector, which is characterized by high detection efficiency and speed, the capability to operate at high X-ray fluxes and to provide high two dimensional imaging accuracy.

There is thus provided in accordance with a preferred embodiment of the present invention an X-ray detector including a photocathode arranged to receive X-ray radiation and being operative to provide in response thereto an output of electrons, and at least one electron multiplier operative at subatmospheric pressure and in response to the output of electrons from the photocathode to provide an avalanche including an increased number of electrons.

According to another preferred embodiment of the invention the electron multiplier is operative at any suitable (not necessarily subatmospheric) pressure and the electron multiplier may be a multistage electron multiplier.

Preferably, there is also provided an electrode and a readout system for detecting the electrons produced by the electron multiplier, or alternatively, an optical recording system which records photons produced during the electron multiplication process.

In accordance with one embodiment of the invention, the photodetector includes one or more photocathode foils, which may be formed of CsI, CuI, Au, Ta etc. According to an alternative embodiment of the invention, the photodetector may include a porous or amorphous material such as CsI having typically 1%-3% of the bulk density.

In accordance with one embodiment of the invention, the electron multiplier includes a large area, preferably relatively low-pressure multistage chamber, with various electrode geometries and readout methods. Alternatively, the chamber may be at any suitable pressure.

Further in accordance with a preferred embodiment of the present invention, the X-ray detector includes at least one detecting means for detecting an indication of at least one characteristic of the electron avalanche produced by the electron multiplier.

In accordance with an alternative preferred embodiment of the present invention, the at least one electron multiplier includes at least one detecting means for detecting an indication of at least one characteristic of the electron avalanche produced by the electron multiplier.

Further in accordance with a preferred embodiment of the present invention, the X-ray detector also includes a large area chamber and at least the photocathode and the at least one electron multiplier are located interiorly of the chamber.

Still further in accordance with a preferred embodiment of the present invention, a non-aging high gain-providing gas is provided interiorly of the chamber.

Additionally in accordance with a preferred embodiment of the present invention, the electron multiplier defines at least one amplification stage and at least one transfer stage.

Further in accordance with a preferred embodiment of the present invention, the at least one amplification stage includes at least two amplification stages.

Still further in accordance with a preferred embodiment of the present invention, at least one of the at least one transfer stages is defined before the at least one amplification stage.

Additionally in accordance with a preferred embodiment of the present invention, the at least one transfer stage includes a plurality of transfer stages.

Still further in accordance with a preferred embodiment of the present invention, the plurality of transfer stages includes at least three transfer stages.

Additionally in accordance with a preferred embodiment of the present invention, at least one of the at least one transfer stages is defined after the amplification stage.

Still further in accordance with a preferred embodiment of the present invention, the electron multiplier includes at least one gate electrode before at least one of the least one amplification stages for receiving a selected one of at least two selectable voltage levels.

Further in accordance with a preferred embodiment of the present invention, the at least one gate electrode includes at least two gate electrodes.

Still further in accordance with a preferred embodiment of the present invention, the electron multiplier also defines a pre-amplification stage before the amplification stage.

Additionally in accordance with a preferred embodiment of the present invention, at least one of the at least one transfer stages is defined before the preamplification stage and the at least one amplification stage.

Further in accordance with a preferred embodiment of the present invention, the detecting means includes electron detection means for detecting the electrons produced by the electron avalanche.

Still further in accordance with a preferred embodiment of the present invention, the electron detection means includes a plurality of pad electrode assemblies for collecting the electrons produced by the electron multiplier.

Additionally in accordance with a preferred embodiment of the present invention, each of the pad electrode assemblies includes a pad electrode, an insulative layer and a resistive layer.

Still further in accordance with a preferred embodiment of the present invention, the electron detection means includes at least one strip electrode array, the strip electrode array including a first plurality of mutually parallel strip electrodes, generally planar insulating means, defining a plane generally parallel to the first plurality of mutually parallel strip electrodes and a second plurality of mutually parallel strip electrodes, arranged generally parallel to the plane and generally perpendicular to the first plurality of strip electrodes.

Further in accordance with a preferred embodiment of the present invention, the detecting means includes photon detection means for detecting photons emitted during the electron avalanche.

Still further in accordance with a preferred embodiment of the present invention, the photocathode is generally planar and is configured and arranged to receive X-ray radiation impinging on both sides thereof.

Additionally in accordance with a preferred embodiment of the present invention, the at least one electron multiplier includes two electron multipliers.

Further in accordance with a preferred embodiment of the present invention, the at least one detecting means includes two detecting means.

Still further in accordance with a preferred embodiment of the present invention, the at least one electron multiplier includes two electron multipliers disposed respectively on the two sides of the planar photocathode.

Additionally in accordance with a preferred embodiment of the present invention, the at least one detecting means includes two detection means disposed respectively on the two sides of the planar photocathode.

Further in accordance with a preferred embodiment of the present invention, the photocathode includes a metal foil.

Still further in accordance with a preferred embodiment of the present invention, the photocathode includes an insulative support layer and at least one semiconductive layers disposed on respective at least one sides of the support layer.

Additionally in accordance with a preferred embodiment of the present invention, the photocathode includes an insulative support layer and at least one conductive layers disposed on respective at least one sides of the support layer.

Further in accordance with a preferred embodiment of the present invention, the photocathode includes a conductive support layer and at least one insulative layer disposed on respective at least one sides of the support layer.

Still further in accordance with a preferred embodiment of the present invention, the photocathode includes a conductive support layer and at least one semiconductive layer disposed on respective at least one sides of the support layer.

Additionally in accordance with a preferred embodiment of the present invention, the photocathode includes an insulative support layer and at least one noninsulative element disposed on respective at least one sides of the support layer, each noninsulative element including a semiconductive layer and a conductive layer.

Further in accordance with a preferred embodiment of the present invention, the photocathode includes an insulative support layer and at least one photocathode element disposed on respective at least one sides of the support layer, each photocathode element including an insulative layer and a conductive layer.

Still further in accordance with a preferred embodiment of the present invention, the photocathode includes a conductive support layer and at least one low-density non-conductive layers disposed on respective at least one sides of the support layer.

Additionally in accordance with a preferred embodiment of the present invention, the photocathode includes a support layer and at least one photocathode element disposed on respective at least one sides of the support layer, each photocathode element including a metal layer and a nonconductive layer.

Further in accordance with a preferred embodiment of the present invention, the photocathode includes a porous material.

Still further in accordance with a preferred embodiment of the present invention, the at least one characteristic includes at least one of the following characteristics: the number of electrons in the avalanche, the location of the avalanche, and the time of occurrence of the avalanche.

Additionally in accordance with a preferred embodiment of the present invention, the gas is generally light-emitting.

Still further in accordance with a preferred embodiment of the present invention, the at least one detecting means includes at least one electrode for providing the avalanche and for providing the indication of the at least one characteristic of the electron avalanche.

Further in accordance with a preferred embodiment of the present invention, the at least one electrode includes a plurality of conductive elements.

Still further in accordance with a preferred embodiment of the present invention, the plurality of conductive elements includes a plurality of wires.

Further in accordance with a preferred embodiment of the present invention, there is provided an X-ray detector assembly including a gas filled enclosure and a plurality of X-ray detectors located interiorly of the gas filled enclosure, each individual one of the plurality of X-ray detectors preferably being constructed and operative as above.

In accordance with a further preferred embodiment of the present invention there is provided an X-ray detecting method including the steps of providing a photocathode arranged to receive X-ray radiation and being operative to provide in response thereto an output of electrons, and, in response to the output of electrons from the photocathode, providing at subatmospheric pressure an avalanche including an increased number of electrons.

Further in accordance with a preferred embodiment of the present invention, the method also includes the step of detecting an indication of at least one characteristic of the electron avalanche.

BRIEF DESCRIPTION OF THE DRAWINGS

The present invention will be understood and appreciated from the following detailed description, taken in conjunction with the drawings in which:

FIG. 1I is a schematic illustration of a X-ray photon detector constructed and operative in accordance with another preferred embodiment of the present invention;

FIGS. 6A, 6B, 6C, 6D, 6E, 6F, and 6G are sectional illustrations of seven alternative embodiments of photocathode assemblies useful in the present invention.

DETAILED DESCRIPTION OF PREFERRED EMBODIMENTS

Figure 1A:
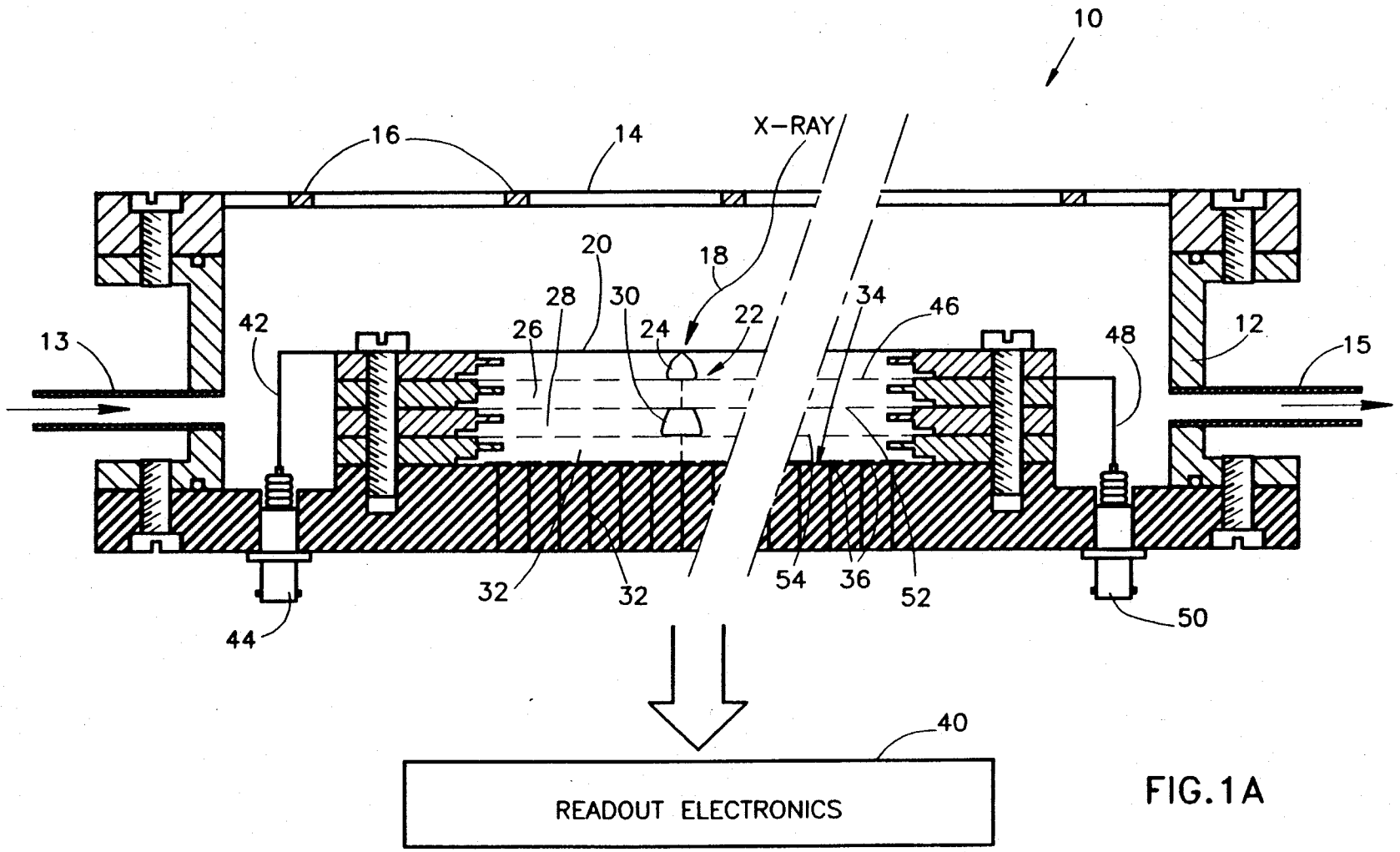
FIG. 1A is a schematic illustration of a X-ray photon detector having an electronic readout which is constructed and operative in accordance with one preferred embodiment of the present invention.

Reference is now made to FIG. 1A, which illustrates an X-ray detector constructed and operative in accordance with a preferred embodiment of the present invention. The X-ray detector, indicated generally by reference numeral 10 comprises a preferably low-pressure gas filled enclosure 12 including a gas entry conduit 13, an X-ray photon entrance window 14, and a gas exit conduit 15. The circulated gas is typically at approximately 20 Torr pressure and at stabilized room temperature. Alternatively, the apparatus can operate at any other suitable pressure. The examples set forth hereinbelow are directed to subatmospheric pressure applications.

Entrance window 14 is typically formed of polypropylene or of Mylar or Kapton foil and is supported on a frame 16. The thickness of the foil may vary as a function of the energy of the impinging X-ray photons. For example, for photons of energy 10 KeV, a preferred thickness would be 5-10 microns.

X-ray photons passing through window 14, as indicated by reference numeral 18, impinge on a photocathode 20. Various embodiments of photocathodes suitable for use in the apparatus of FIG. 1A, are illustrated in FIGS. 6A-6G and are described in detail hereinbelow. The impingement of the X-ray photons on the photocathode 20 causes the release of electrons from the photocathode at the location of the impingement. The released electrons are amplified in a pre-amplification stage 22 to produce an initial avalanche, as illustrated by reference numeral 24. The electron avalanche is transferred via a transfer gap 26 to an amplification stage 28, which produces a second avalanche 30.

Figure 3A:
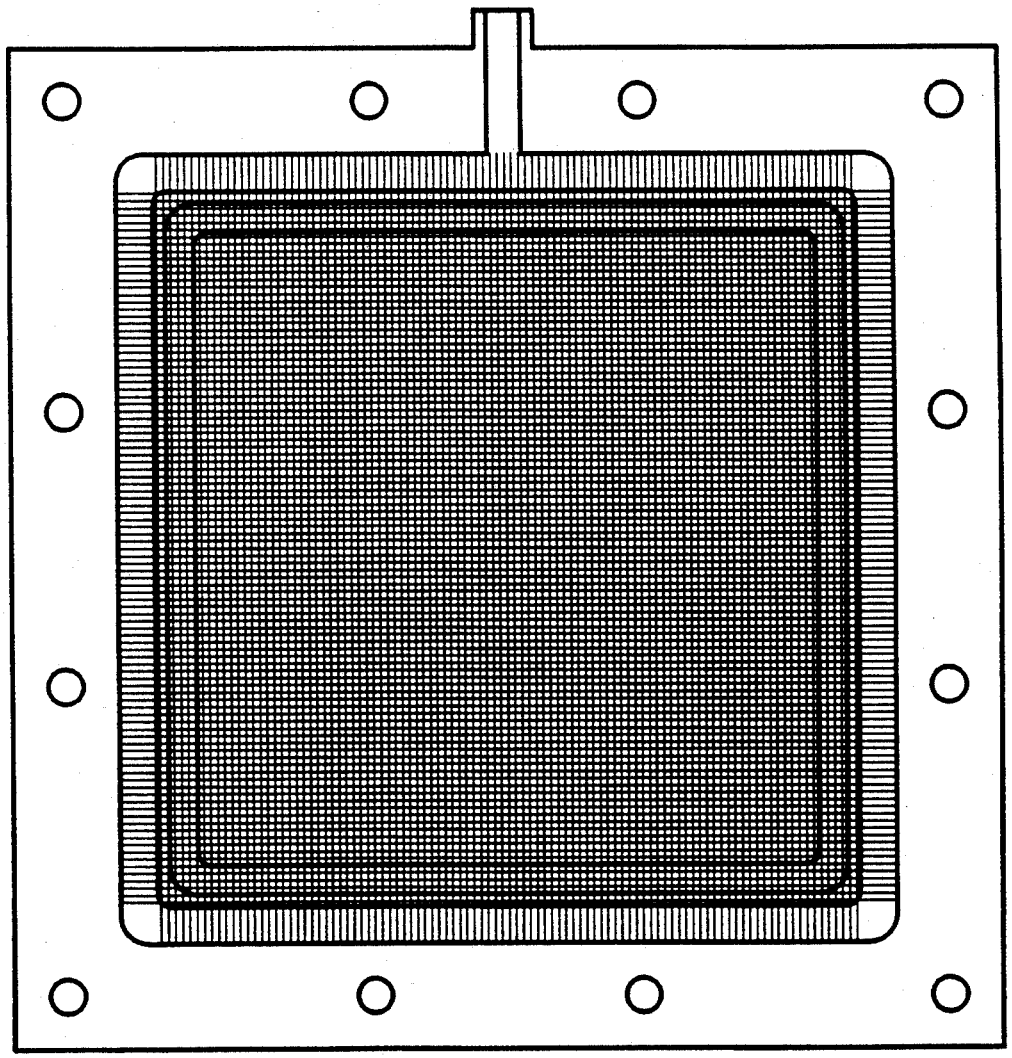
FIGS. 3A, 3B, 3C and 3D are planar illustrations of various embodiments of electrodes useful in the apparatus of FIGS. 1A–2B.

The electrons in second avalanche 30 are transferred through a second transfer stage 32 and are collected by an array 34 of pad electrodes 36. A typical configuration of array 34 of pad electrodes 36 is shown in FIG. 3C. The pad electrodes are typically of square configuration and of side length 2-10 mm. Preferably the pad electrodes 36 are separated from adjacent pad electrodes by 0.1-0.3 mm. The pad electrodes are preferably formed of copper formed over an epoxy laminated printed circuit board. The output signals of electrodes 36 are transmitted via conductors 38 to readout electronics 40, as described in P. Fischer et al., IEEE Trans. Nucl. Sci. NS-35 (1988), p. 432 onward, the disclosure of which is incorporated herein by reference. The electronic information from detector 10 is preferably computer processed to obtain values for integral charge and for center of gravity, using known methods and a suitable computer such as a Microvax II, commercially available from Digital Equipment Corporation, where it is stored and processed for data analysis.

It is appreciated that the structure downstream of the photocathode 20 is an electron multiplier. Typically, the photocathode 20 receives a negative voltage via a conductor 42, which is coupled to a voltage source (not shown) via an insulative connector 44. In such a case, the pre-amplification stage 22 is also defined by a mesh electrode 46, which typically is maintained at a desired voltage by means of a conductor 48 coupled to a voltage source (not shown) via an insulative connector 50.

Typical voltages and gap separations at these stages for a typical gas pressure of 20 Torr are as follows:

| STAGE | GAP THICKNESS (mm) | VOLTAGE DIFFERENCE (volt) |
|---|---|---|
| pre-amplification | 3.5 | 800 |
| first transfer | 3.5 | 160 |
| amplification | 3.5 | 800 |
| second transfer | 3.5 | 400 |

A preferred level of potential for the readout electrodes 36 is 0 volts. In such a case, the preferred levels of potential for the photocathode 20 and for the respective electrodes 46, 52, 54, and 36 of each stage are:

−2160 V, −1360 V, −1200 V, −400 V, and 0 V.

The gas here and in the embodiments of the present invention shown in FIGS. 1B-1I may comprise any suitable gas which, at relatively low pressure, is non-aging and provides high gain (i.e. high amplification). Typical gases having these characteristics are: dimethylether, isobutane, $CF_4$, $CH_4$, $C_2H_6$, methylal, alcohols such as isopropanol and ethyl alcohol, and mixtures of any of the above.

The additional mesh electrodes 52 and 54 each receive an appropriate voltage supply via corresponding conductors and connectors (not shown). The mesh electrodes are typically formed of stainless steel wires of 50 micron diameter, defining square openings of 500 micron side length. A typical configuration of mesh electrodes 46, 52 and 54 is illustrated in FIG. 3A. These meshes are commercially available from Bopp AG, Bachnannweg 20, CH-8046 Zurich, Switzerland.

Figure 1B:
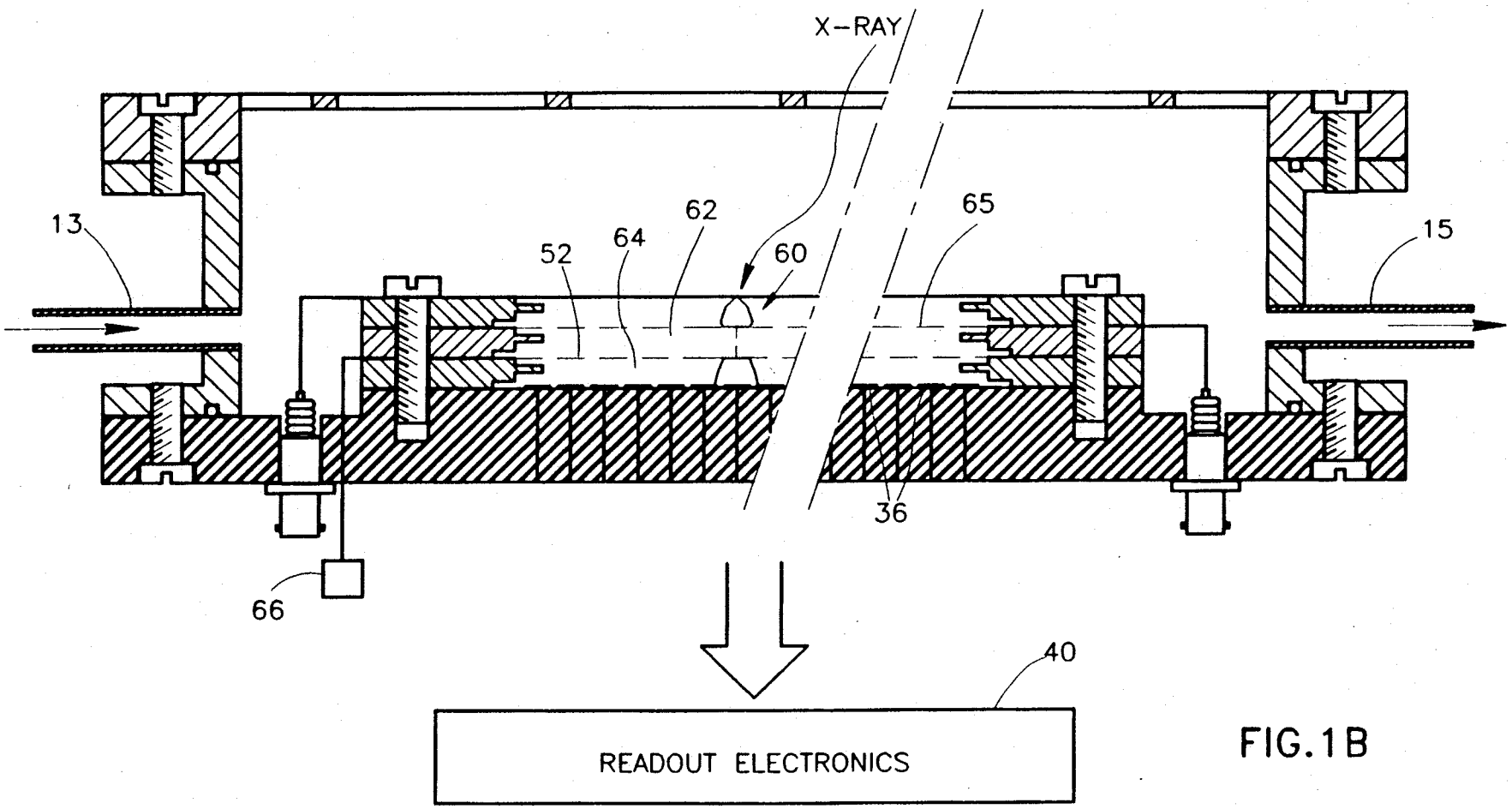
FIG. 1B is a schematic illustration of a X-ray photon detector constructed and operative in accordance with another preferred embodiment of the present invention.

Reference is now made to FIG. 1B, which illustrates an alternative embodiment of the invention employing a different type of electron multiplier. The remainder of the apparatus is essentially identical to that described hereinabove in connection with FIG. 1A and therefore, similar elements thereof are indicated by identical reference numerals.

In the embodiment of FIG. 1B, an electron multiplier having a pre-amplification stage 60, a transfer stage 62 and an amplification stage 64 is employed.

Typical voltages and gap separations at these stages for a gas pressure of 20 Torr are as follows:

| STAGE | GAP THICKNESS (mm) | VOLTAGE DIFFERENCE (volt) |
|---|---|---|
| pre-amplification | 3.5 | 800 |
| transfer | 3.5 | 80 |
| amplification | 3.5 | 800 |

A preferred level of potential for the readout electrodes 36 is 0 V. In such a case, the preferred levels of potential for the photocathode 20 and for the respective electrodes 65, 52 and 36 of each stage are:

−1680 V, −880 V, −800 V, and 0 V.

According to a preferred embodiment of the present invention, one of the mesh electrodes, preferably electrode 52, between the transfer stage and the amplification stage, receives a selectably changeable voltage provided by a voltage source (not shown) via a switch 66, such as an HV 1000 Pulser, commercially available from DEI, 2301 Research Blvd., Suite 101, Fort Collins, Colorado, USA. Typically, two voltage levels are provided. This arrangement enables mesh electrode 52 to act as a gate, having defined open and closed positions thereof, corresponding to the two voltage levels, thereby determining whether the electrons from the pre-amplification stage reach the amplification stage. Another function of the gate is to substantially prevent positive ions from drifting back to the photocathode and causing damage thereto. Alternatively, the gating function may be eliminated.

Where gating is employed the typical voltages and gap separations at the various stages for a gas pressure of 20 Torr are as follows:

| STAGE | GAP THICKNESS (mm) | VOLTAGE DIFFERENCE (volt) |
|---|---|---|
| pre-amplification | 3.5 | 800 |
| transfer | 3.5 | 80 (gate open)<br>−20 (gate closed) |
| amplification | 3.5 | 800 (gate open)<br>900 (gate closed) |

A preferred level of potential for the readout electrodes 36 is 0. In such a case, the preferred levels of potential for the photocathode 20 and for the respective electrodes 65, 52 and 36 of each stage are:

gate open: −1680 V, −880 V, −800 V, and 0 V gate closed: −1680 V, −880 V, −900 V, and 0 V.

It is noted that in the embodiment of FIG. 1B, the amplification stage causes the avalanche electrons to be collected directly at the pad electrodes 36.

Figure 1C:
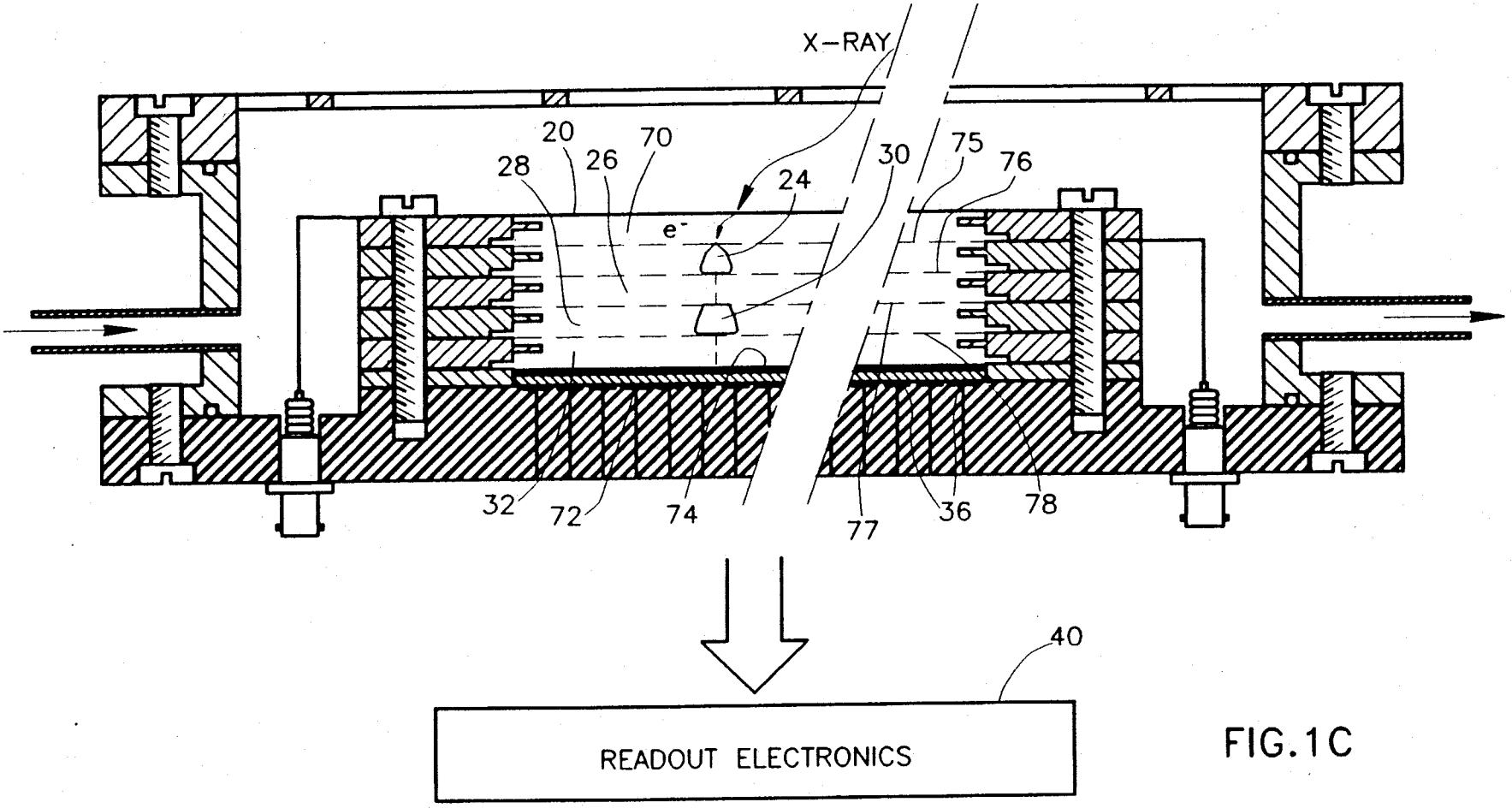
FIG. 1C is a schematic illustration of a X-ray photon detector constructed and operative in accordance with yet another preferred embodiment of the present invention.

Reference is now made to FIG. 1C, which illustrates yet another embodiment of X-ray detector constructed and operative in accordance with a preferred embodiment of the present invention. In this embodiment yet another type of electron multiplier is employed. Here the electrons emitted by the photocathode 20 initially pass through a transfer stage 70 and are subsequently amplified in a plurality of stages identical to that illustrated in FIG. 1A.

There is also provided over the pad electrodes 36 an insulative layer 72, typically formed of epoxy laminate and of thickness 200 microns. Over insulative layer 72, there is provided a resistive layer 74, typically formed of graphite, or of a polymer paste, commercially available from Minico/Ashai Chemical of America, 50 North Harrison Ave., Congres, N.Y., USA. Resistive layer 74 has a typical resistivity of 10 MOhm/square. This structure allows operation of the photocathode at zero potential with the pad electrodes 36 at zero potential as well.

The remainder of the apparatus is essentially identical to that described hereinabove in connection with FIG. 1A and therefore, similar elements thereof are indicated by identical reference numerals.

Typical voltages and gap separations at these stages for a gas pressure of 20 Torr are as follows:

| STAGE | GAP THICKNESS (mm) | VOLTAGE DIFFERENCE (volt) |
|---|---|---|
| transfer 1 | 3.5 | 100 |
| pre-amplification | 3.5 | 800 |
| transfer 2 | 3.5 | 80 |
| amplification | 3.5 | 800 |
| transfer 3 | 3.5 | 400 |

A preferred level of potential for the photocathode 20 is 0 volts. In such a case, the preferred levels of potential for the photocathode 20, for the electrodes 75, 76, 77 and 78 and for the resistive layer 74, respectively, are:

0 V, 100 V, 900 V, 980 V, 1780 V, and 2180 V.

Figure 1D:
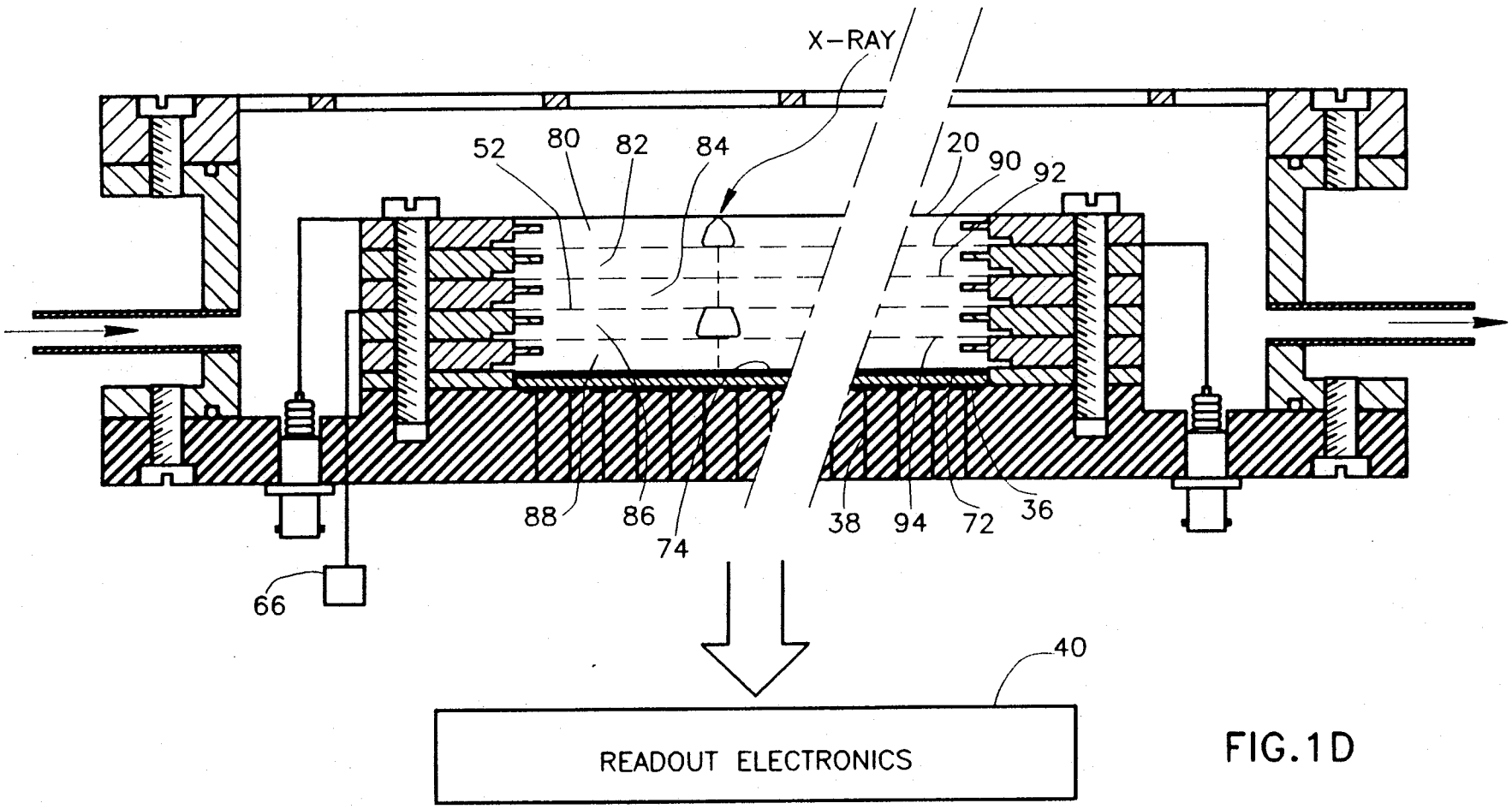
FIG. 1D is a schematic illustration of a X-ray photon detector constructed and operative in accordance with still another preferred embodiment of the present invention.

Reference is now made to FIG. 1D, which illustrates yet another embodiment of X-ray detector constructed and operative in accordance with a preferred embodiment of the present invention. In this embodiment yet another type of electron multiplier is employed, having a pre-amplification stage 80, first and second transfer stages 82 and 84, an amplification stage 86, and a third transfer stage 88.

Preferably there is provided a mesh electrode 52 between the second transfer and the amplification stages, which receives selectably changeable voltage via switch 66 and which consequently acts as a gate, as described hereinabove in connection with FIG. 1B.

Typical potentials across each stage and gap separations for each stage, for a gas pressure of 20 Torr are as follows:

| STAGE | GAP THICKNESS (mm) | VOLTAGE DIFFERENCE (volt) |
|---|---|---|
| pre-amplification | 3.5 | 800 |
| transfer 1 | 3.5 | 80 |
| transfer 2 | 3.5 | 80 (gate open)<br>−20 (gate closed) |
| amplification | 3.5 | 800 (gate open)<br>900 (gate closed) |
| transfer 3 | 3.5 | 400 |

A preferred level of potential for the photocathode 20 is 0 volts. In such a case, the preferred levels of potential for the photocathode 20, for the electrodes 90, 92, 52 and 94 and for resistive layer 74 are:

gate open: 0 V, 800 V, 880 V, 960 V, 1760 V, and 2160 V gate closed: 0 V, 800 V, 880 V, 860 V, 1760 V, and 2160 V.

There is also preferably provided an insulative layer 72 and a resistive layer 74 which may be identical to the respective layers 72 and 74 of FIG. 1C.

The remainder of the apparatus is essentially identical to that described hereinabove in connection with FIG. 1A, and therefore, similar elements thereof are indicated by identical reference numerals.

Figure 1E:
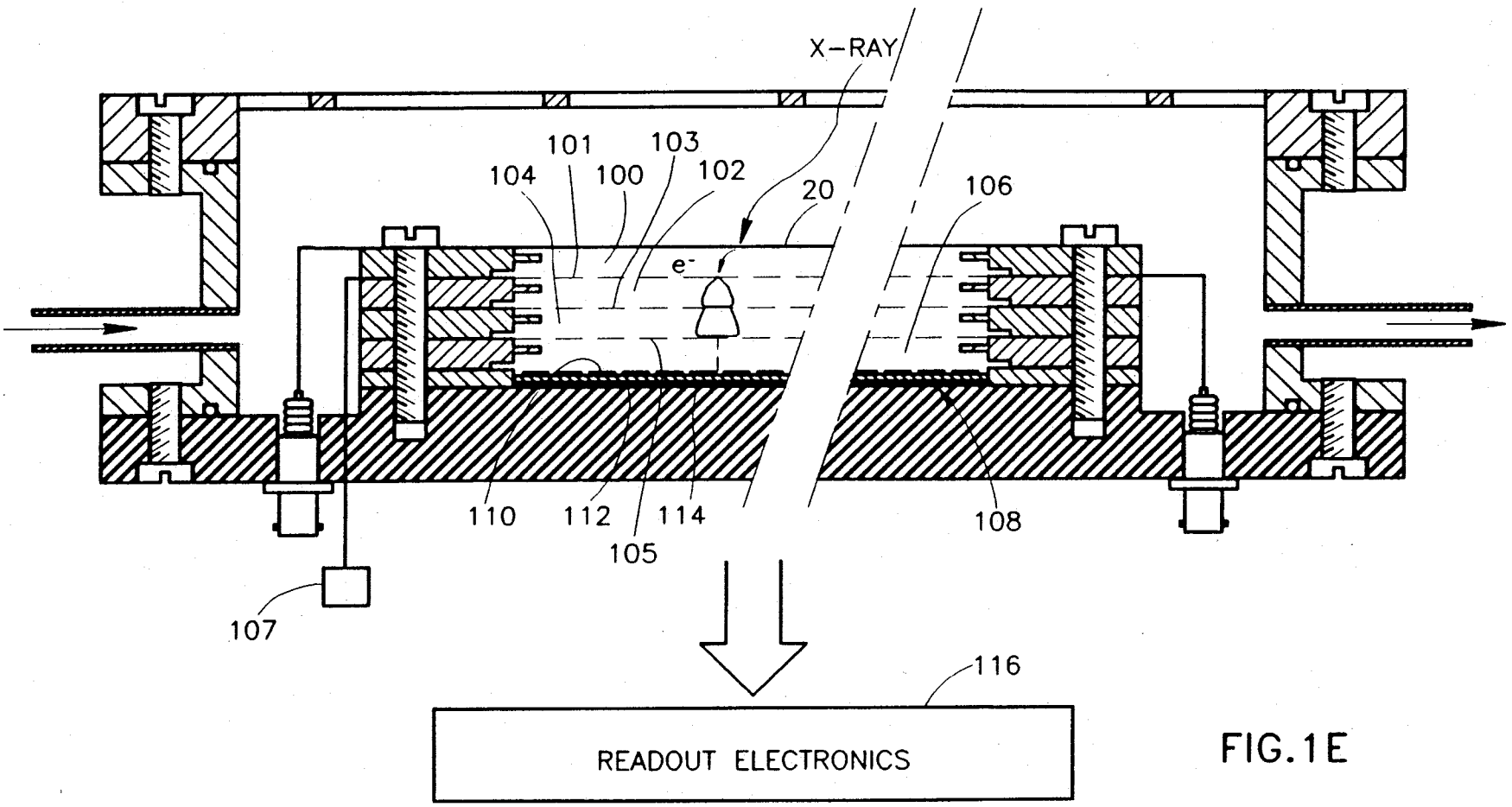
FIG. 1E is a schematic illustration of a X-ray photon detector constructed and operative in accordance with a further preferred embodiment of the present invention.

Reference is now made to FIG. 1E, which illustrates yet another embodiment of X-ray detector constructed and operative in accordance with a preferred embodiment of the present invention. In this embodiment yet another type of electron multiplier is employed, having a first transfer stage 100, a preamplification stage 102, an amplification stage 104 and a second transfer stage 106. Typical potentials across each stage and gap separations for each stage, for a gas pressure of 20 Torr are as follows:

| STAGE | GAP THICKNESS (mm) | VOLTAGE DIFFERENCE (volt) |
|---|---|---|
| transfer 1 | 3.5 | 80 |
| pre-amplification | 3.5 | 800 |
| amplification | 3.5 | 800 |
| transfer 2 | 3.5 | 400 |

A preferred level of potential for the electrodes 110 is 0 volts. In such a case, the preferred levels of potential for the photocathode 20 and for the respective electrodes 101, 103, 105 and 110 of each stage are:

−2080 V, −2000 V, −1200 V, −400 V, and 0 V.

According to a preferred embodiment of the present invention, one of the mesh electrodes, preferably electrode 101, between the first transfer stage 100 and the preamplification stage 102, receives a selectably changeable voltage from a voltage source (not shown) via a switch 107, such as an HV 1000 Pulser, commercially available from DEI, 2301 Research Blvd., Suite 101, Fort Collins, Colo. USA. Typically, two voltage levels are provided. This arrangement enables mesh electrode 101 to act as a gate, having defined open and closed positions thereof, corresponding to the two voltage levels. The function of the gate is to prevent positive ions from drifting back to the photocathode 20 and causing damage thereto, when the gate is closed. Alternatively, the gating function may be eliminated.

If gating is employed the typical voltages and gap separations at the various stages for a gas pressure of 20 Torr are as follows:

| STAGE | GAP THICKNESS (mm) | VOLTAGE DIFFERENCE (volt) |
|---|---|---|
| transfer 1 | 3.5 | 80 (gate open) |
| | 3.5 | −20 (gate closed) |
| pre-amplification | 3.5 | 800 (gate open) |
| | 3.5 | 900 (gate closed) |
| amplification | 3.5 | 800 |
| transfer 2 | 3.5 | 400 |

A preferred level of potential for the electrodes 110 is 0 volts. In such a case, the preferred levels of potential for the photocathode 20 and for the respective electrodes 101, 103, 105 and 110 of each stage are:

gate closed: −2080 V, −2100 V, −1200 V, −400 V, and 0 V.

gate open: −2080, −2000, −1200, −400, OV.

Figure 3B:
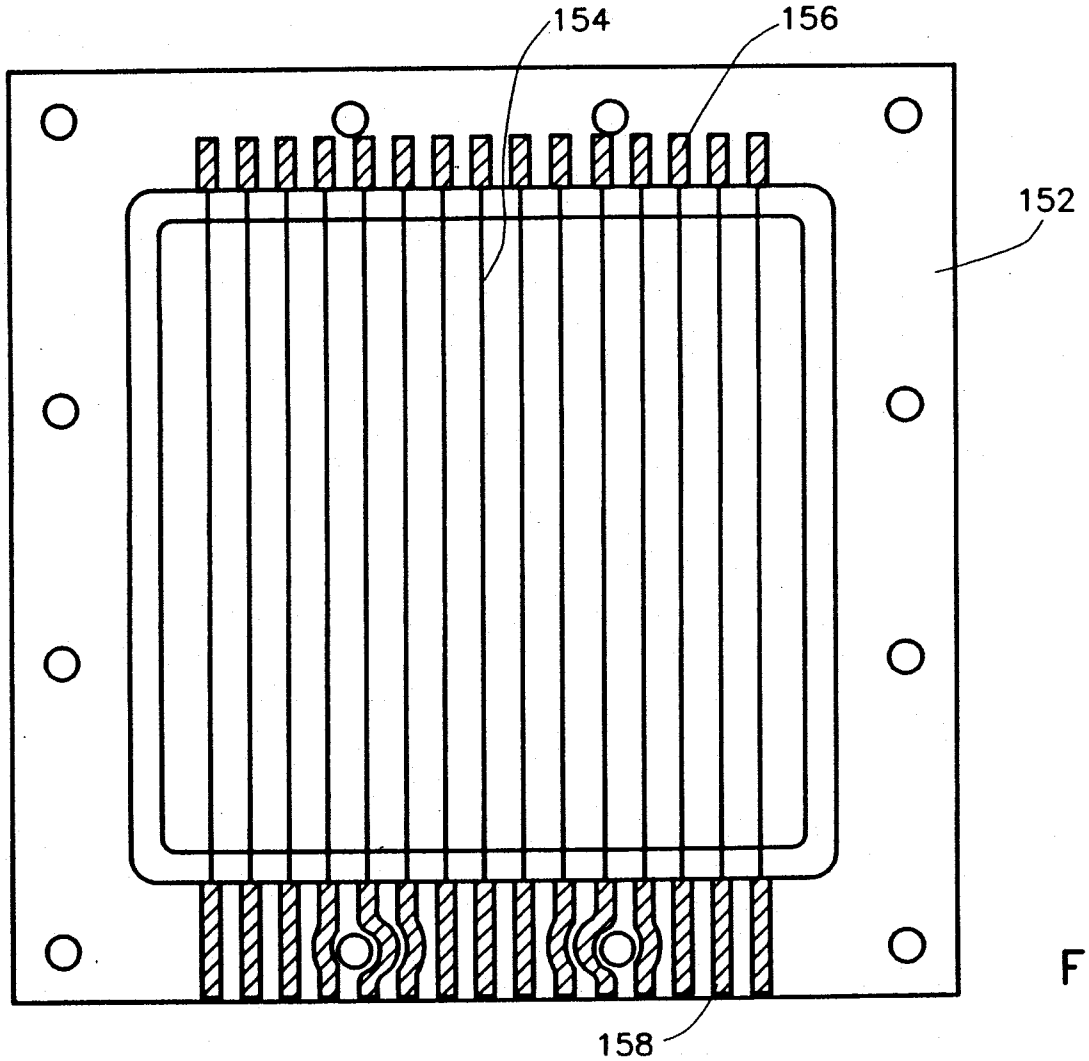
Figure 3C:
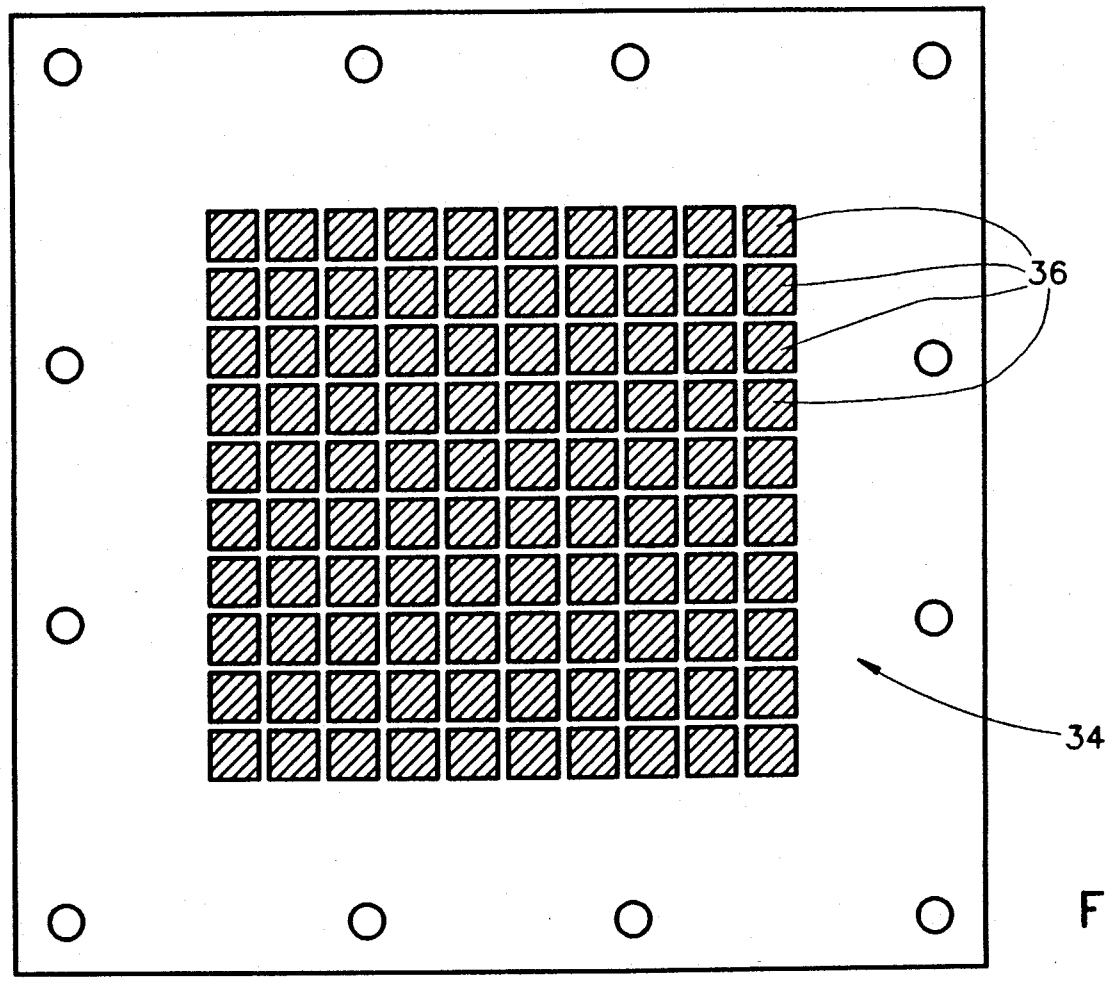
Figure 3D:
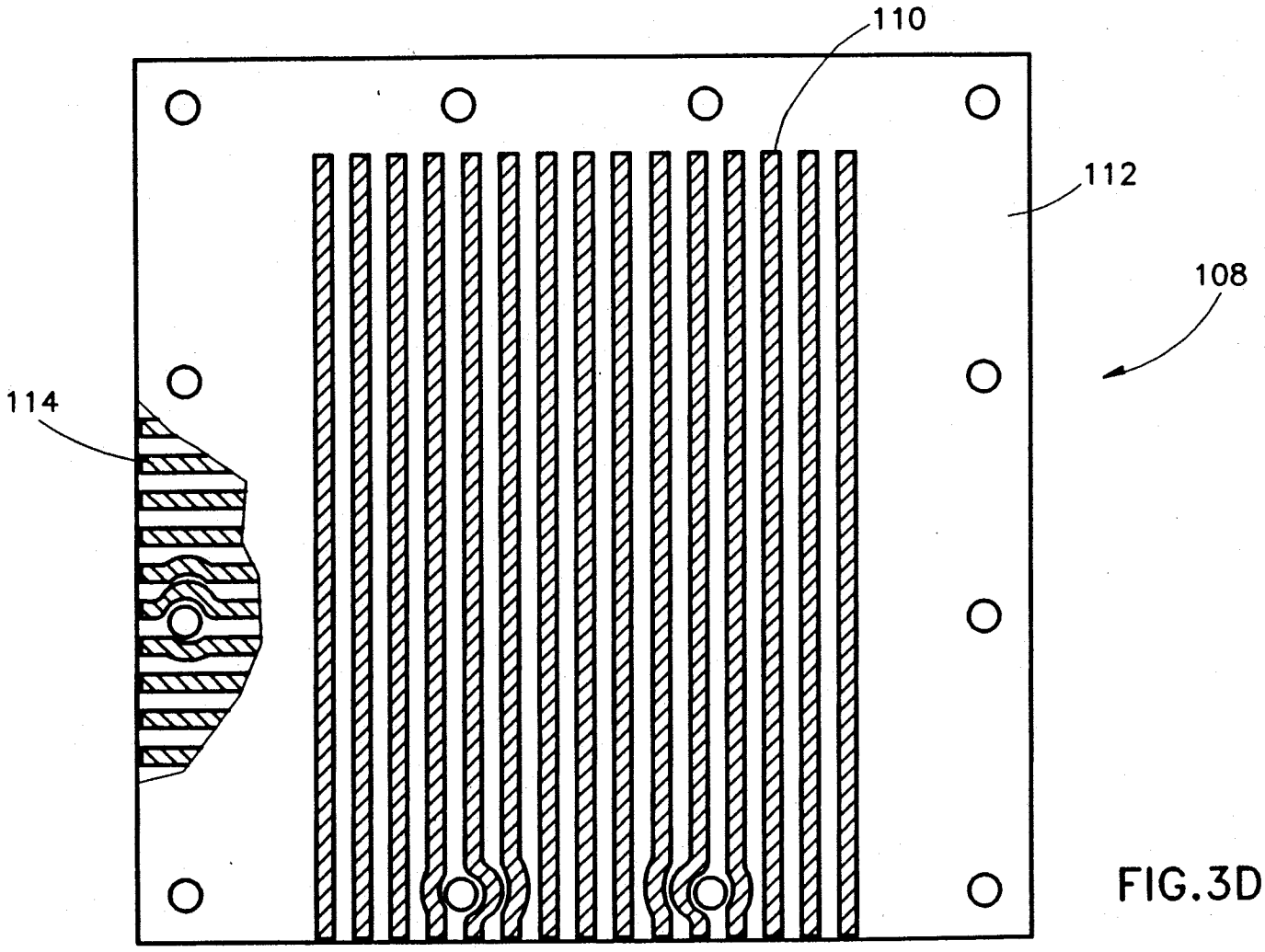

Electrode array 34 of FIG. 1A is here replaced by a readout electrode assembly 108 shown in detail in FIG. 3D, typically comprising a first array of strip electrodes 110, typically in mutually parallel orientation, a generally planar insulating element 112 and a second array of strip electrodes 114, typically in mutually parallel orientation and being generally perpendicular to the orientation of strip electrodes 110.

Electrode arrays 110 and 114 may take any suitable form such as a thin copper layer deposited on both sides of insulating element 112. The width of an electrode strip 110 is typically approximately 1-3 mm and the separation between adjacent strips is typically approximately 0.2-0.5 mm. The width of and separation between electrode strips 114 may be the same. The insulating element 112 may be formed of any suitable material such as epoxy laminate with a typical thickness of 200 microns.

Any suitable method may be employed to read out the information from the strip electrode arrays. The readout electronics 40 of previous embodiments is here replaced by readout electronics 116, such as described in V. Radeka and R. A. Boie, Nucl. Instrum. Methods 178 (1980) 543, the disclosure of which is incorporated herein by reference. Connectors 38 are here replaced by appropriate connectors (not shown) between strip electrode arrays 110 and 114, and readout electronics 116. The remainder of the apparatus is essentially identical to that described hereinabove in connection with FIG. 1A.

Figure 1F:
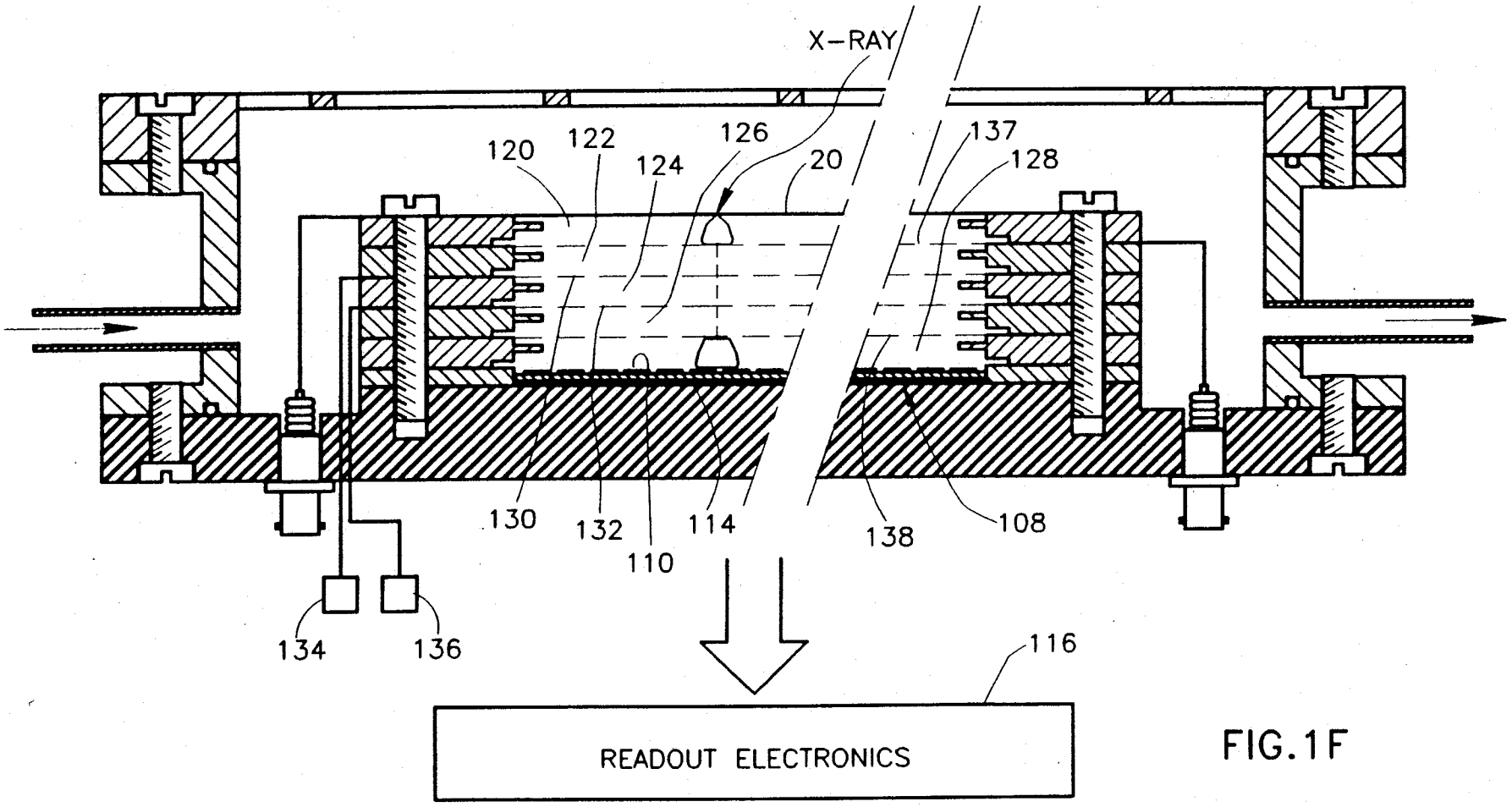
FIG. 1F is a schematic illustration of a X-ray photon detector constructed and operative in accordance with yet a further preferred embodiment of the present invention.

Reference is now made to FIG. 1F, which illustrates yet another embodiment of X-ray detector constructed and operative in accordance with a preferred embodiment of the present invention. In this embodiment yet another type of electron multiplier is employed, having a preamplification stage 120, first, second and third transfer stages 122, 124 and 126, and an amplification stage 128.

There are also typically provided two gate electrodes 130 and 132 on both sides of the second transfer stage which may be identical to gate electrode 52 of FIG. 1B. Electrodes 130 and 132 receive selectably changeable voltages via switches 134 and 136 respectively. The voltages provided via switches 134 and 136 are preferably approximately −50 V and +50 V, respectively.

Typical potentials across each stage and gap separations for each stage, for a gas pressure of 20 Torr are as follows:

| STAGE | GAP THICKNESS (mm) | VOLTAGE DIFFERENCE (volt) |
|---|---|---|
| pre-amplification | 3.5 | 800 |
| transfer 1 | 3.5 | 80 (gate open) |
| transfer 1 | 3.5 | 80 (gate open) |
| | | 130 (gate closed) |
| transfer 2 | 3.5 | 80 (gate open) |
| | | −20 (gate closed) |
| transfer 3 | 3.5 | 80 (gate open) |
| | | 130 (gate closed) |
| amplification | 3.5 | 800 |

A preferred level of potential for the electrode 110 is 0 volts. In such a case, the preferred levels of potential for the photocathode 20 and for the respective electrodes 137, 130, 132, 138 and 110 of each stage are:

gate open: −1840 V, −1040 V, −960 V, −880 V, −800 V, and 0 V gate closed: −1840 V, −1040 V, −910 V, −930 V, −800 V, and 0 V.

Any suitable method may be employed to read out the information from the strip electrode arrays. The readout electronics 40 of previous embodiments is here replaced by readout electronics 116, as in FIG. 1E. Connectors 38 are here replaced by appropriate connectors (not shown) between strip electrode arrays 110 and 114, and readout electronics 116, again as in FIG. 1E. The remainder of the apparatus is essentially identical to that described hereinabove in connection with FIG. 1A, and therefore, similar elements thereof are indicated by identical reference numerals.

Figure 1G:
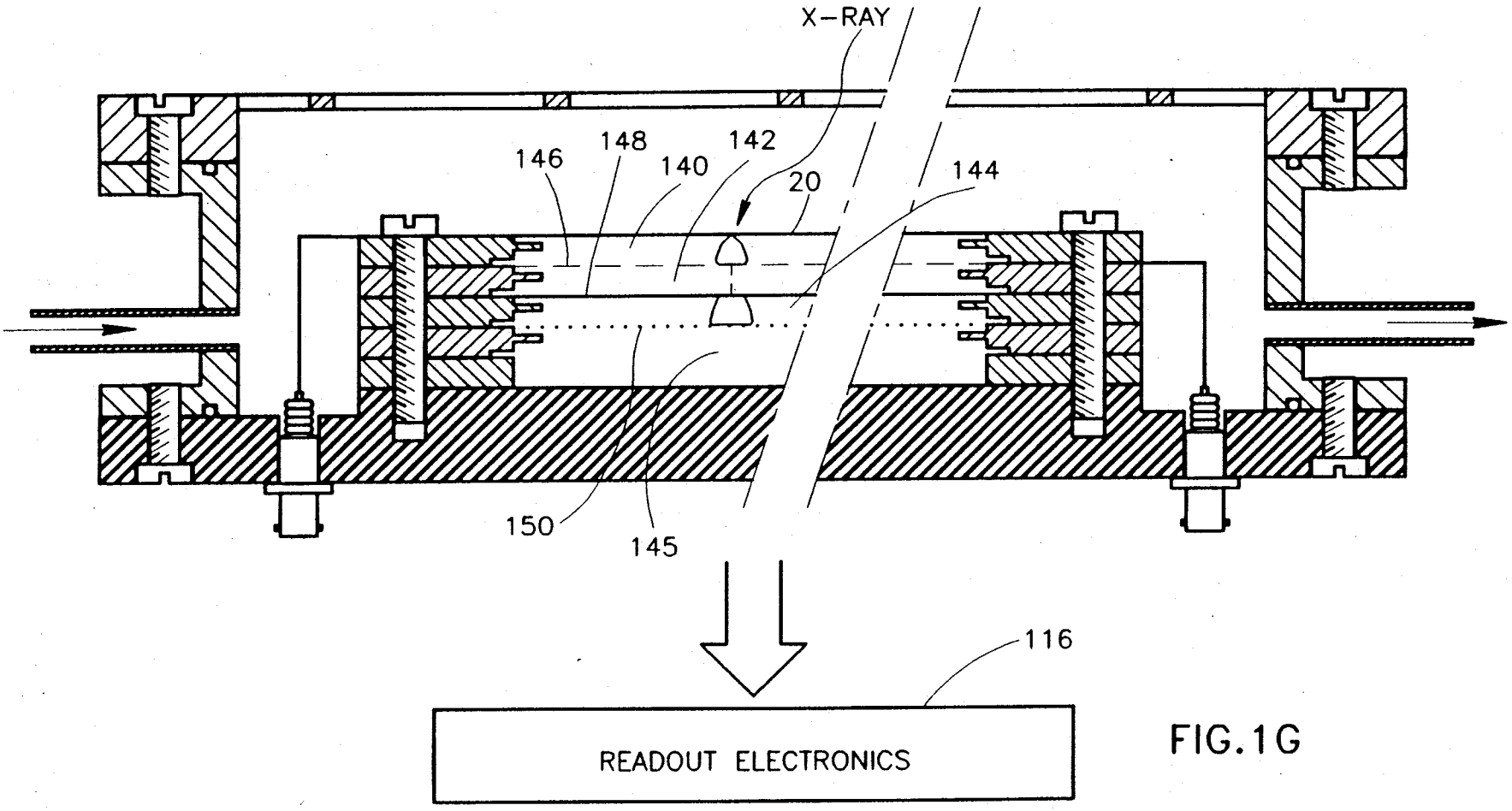
FIG. 1G is a schematic illustration of a X-ray photon detector constructed and operative in accordance with still a further preferred embodiment of the present invention.

Reference is now made to FIG. 1G, which illustrates yet another embodiment of X-ray detector constructed and operative in accordance with a preferred embodiment of the present invention. In this embodiment yet another type of electron multiplier is employed, having a preamplification stage 140, transfer stage 142, an amplification stage 144 and an insulative gap 145.

The electrode 146 between the preamplification stage and transfer stage may be identical to the electrode 52 of FIG. 1A. There are also provided electrode assemblies 148 and 150 defining the amplification stage 144 which are each preferably of the type illustrated in FIG. 3B. Unlike in the previous embodiments in which readout electrode assemblies are provided, in the present embodiment, electrode assemblies 148 and 150 are directly read by readout electronics 116.

Referring now to FIG. 3B, each electrode assembly 148 and each electrode assembly 150 comprises a generally planar insulating element 152, a plurality of wires 154 having a generally mutually parallel orientation and being soldered at each end to corresponding pluralities of soldering taps 156 and 158.

The generally planar insulating element 152 may be formed of any suitable material such as epoxy laminate. The wires may be Tungsten gold-plated and may be of a diameter of approximately 20–100 microns. Suitable wires are commercially available from Lumalampen Corporation, Sweden. The spacing between wires may be approximately 1–2 mm.

Referring again to FIG. 1G, there is provided readout electronics 116 which may be identical to readout electronics 116 of FIG. 1E. Readout electronics 116 is connected to taps 158 by suitable connectors (not shown).

The orientation of the parallel wires 154 of electrode assembly 148 is preferably generally perpendicular to the parallel wires 150.

Typical potentials across each stage and gap separations for each stage, for a gas pressure of 20 Torr are as follows:

| STAGE | GAP THICKNESS (mm) | VOLTAGE DIFFERENCE (volt) |
|---|---|---|
| pre-amplification | 3.5 | 800 |
| transfer | 3.5 | 80 |
| amplification | 3.5 | 800 |

A preferred level of potential for the electrode 150 is 0 volts. In such a case, the preferred levels of potential for the photocathode 20 and for the respective electrodes 146, 148 and 150 of each stage are:

−1680 V, −880 V, −800 V, and 0 V.

The remainder of the apparatus is essentially identical to that described hereinabove in connection with FIG. 1A, and therefore, similar elements thereof are indicated by identical reference numerals.

Figure 1H:
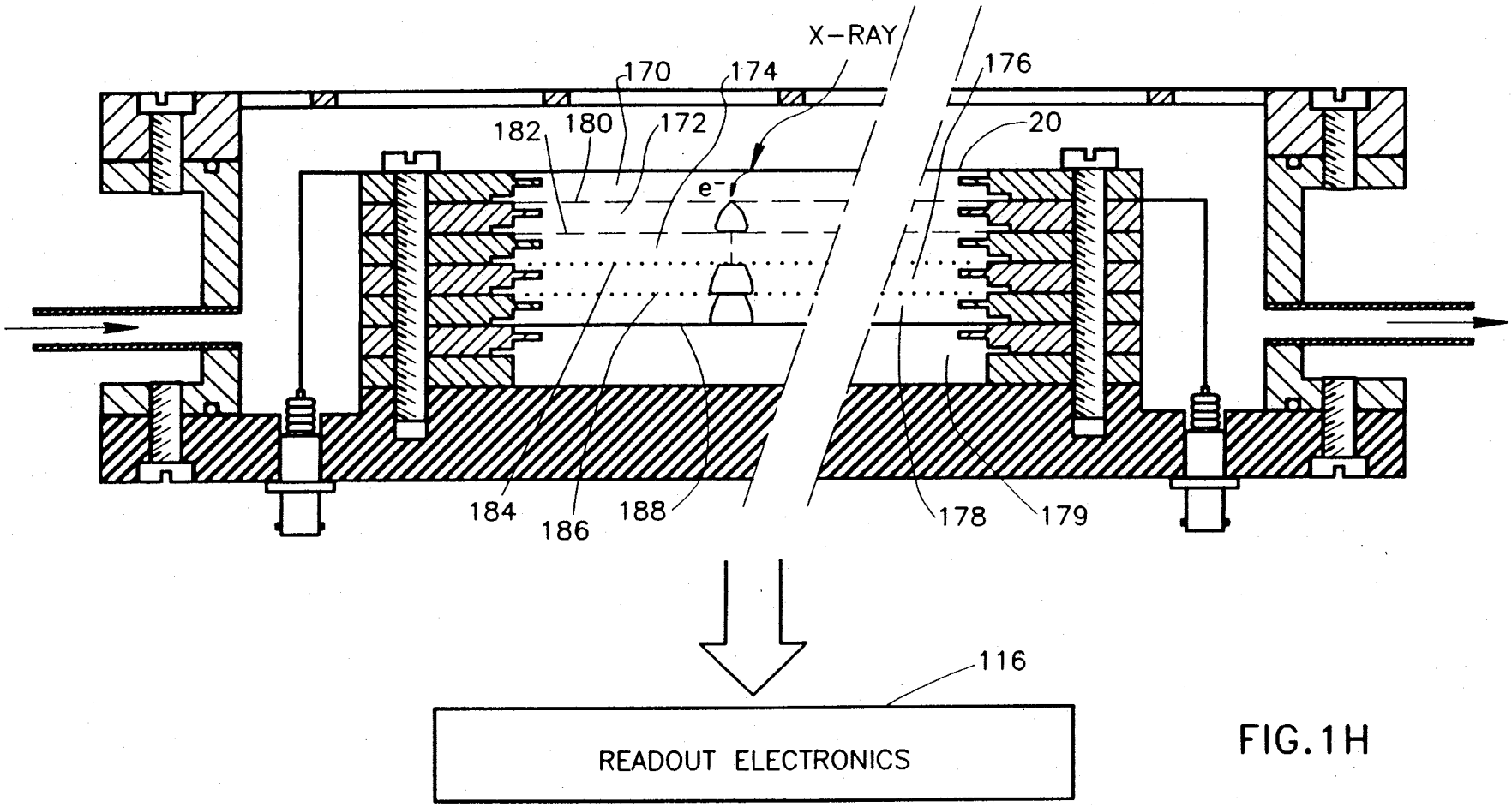
FIG. 1H is a schematic illustration of a X-ray photon detector constructed and operative in accordance with an additional preferred embodiment of the present invention.
Figure 11:
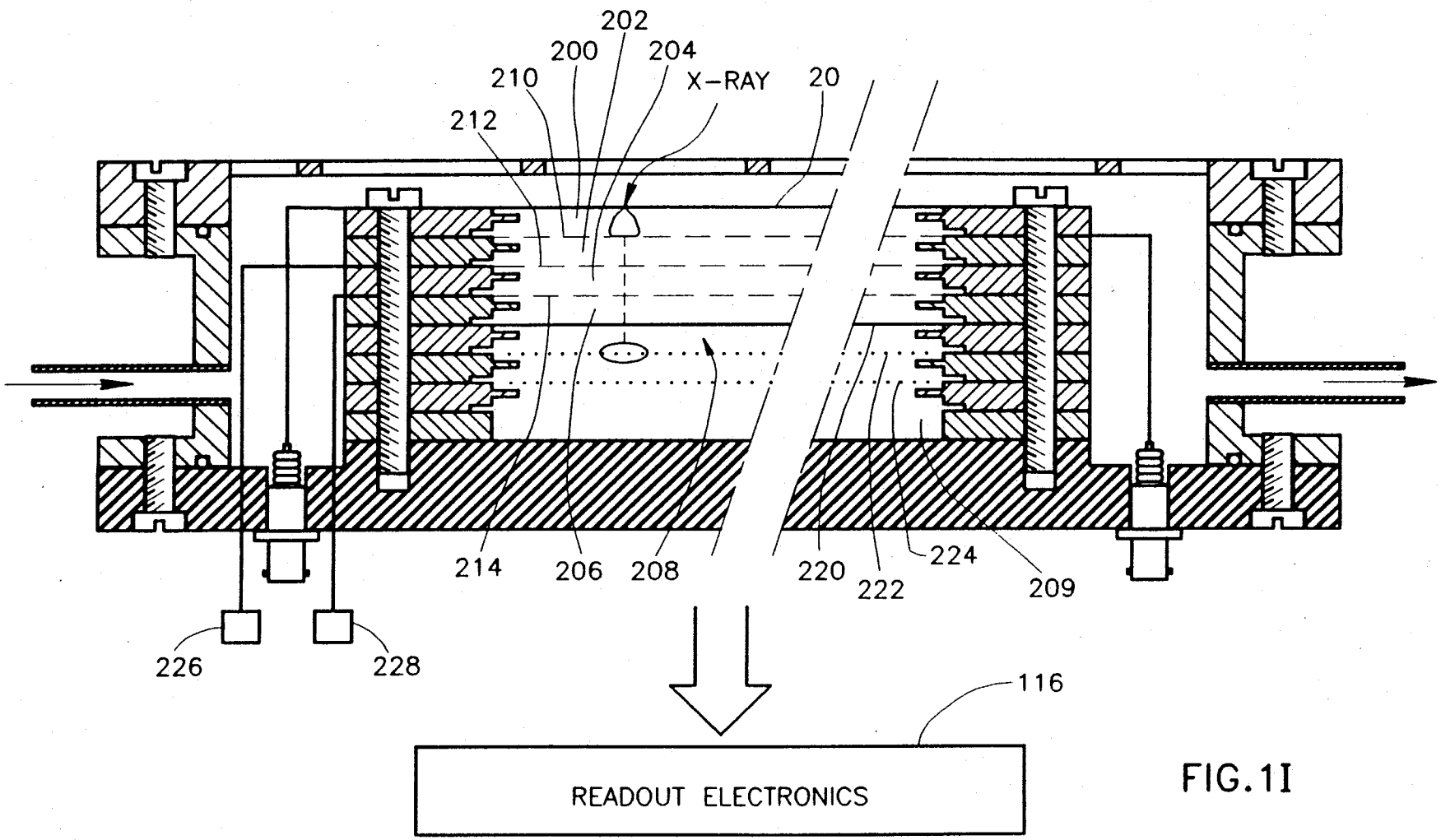

Reference is now made to FIG. 1H, which illustrates yet another embodiment of X-ray detector constructed and operative in accordance with a preferred embodiment of the present invention. In this embodiment yet another type of electron multiplier is employed, having a first transfer stage 170, a preamplification stage 172, a second transfer stage 174, and first and second amplification stages 176 and 178, and an insulative gap 179.

The electrodes 180 and 182 which define the preamplification stage 172 may be identical to the mesh electrode of FIG. 3A. There are also provided electrode assemblies 184, 186 and 188, defining the first and second amplification stages, which may be identical to electrode assemblies 148 and 150 of FIG. 1G. Electrode assemblies 184, 186 and 188 may be arranged such that the respective wires thereof define any desired angle between them. For example, the wires of assemblies 184 and 186 may be parallel to one another, whereas the wires of assembly 188 may be perpendicular to the wires of the other two.

Typical potentials across each stage and gap separations for each stage, for a gas pressure of 20 Torr are as follows:

| STAGE | GAP THICKNESS (mm) | VOLTAGE DIFFERENCE (volt) |
|---|---|---|
| transfer 1 | 3.5 | 100 |
| pre-amplification | 3.5 | 800 |
| transfer 2 | 3.5 | 100 |
| amplification 1 | 3.5 | 800 |

-continued

| STAGE | GAP THICKNESS (mm) | VOLTAGE DIFFERENCE (volt) |
|---|---|---|
| amplification 1 | 3.5 | 600 |

A preferred level of potential for the photocathode 20 is 0 volts. In such a case, the preferred levels of potential for the photocathode 20 and the respective electrodes 180, 182, 184, 186 and 188 of each stage are:

0 V, 100 V, 900 V, 1000 V, 1800 V, and 2400 V.

Any suitable method may be employed to read out the information from the electrode assemblies 184, 186 and 188 (or, alternatively, from assemblies 186 and 188 only). The readout electronics 116 of the present embodiment may be identical to readout electronics 116 of FIG. 1E. Appropriate connectors (not shown) are provided between the electrode assemblies 184, 186 and 188, and readout electronics 116. It is appreciated that, due to this arrangement, a separate readout electrode assembly need not be provided.

The remainder of the apparatus is essentially identical to that described hereinabove in connection with FIG. 1A, and therefore, similar elements thereof are indicated by identical reference numerals.

Reference is now made to FIG. 1I, which illustrates yet another embodiment of X-ray detector constructed and operative in accordance with a preferred embodiment of the present invention. In this embodiment yet another type of electron multiplier is employed, having a preamplification stage 200, first, second and third transfer stages 202, 204 and 206 respectively, an amplification stage 208, and an insulative gap 209. The photocathode 20 is followed by three mesh electrodes 210, 212 and 214 which may be identical to electrode 52 of FIG. 1A, which is illustrated in detail in FIG. 3A. The three mesh electrodes are followed by three electrode assemblies 220, 222 and 224 which define the amplification stage 208 and which are each preferably of the type illustrated in FIG. 3B. However, in the present embodiment, preferred characteristics of the wires of the electrode assemblies are as follows:

Assemblies 220, 224: approximately 50–100 micron diameter wires, approximately 0.5–1 mm apart;

Assembly 222: approximately 20–50 micron diameter wires, approximately 1–2 mm apart.

Electrodes 212 and 214 on both sides of the second transfer stage 204 act as gate electrodes in the present embodiment, receiving selectably changeable voltages via switches 226 and 228 respectively. The voltages provided via switches 226 and 228 are preferably approximately −50 V and +50 V respectively.

Typical potentials across each stage and gap separations for each stage, for a gas pressure of 20 Torr are as follows:

| STAGE | GAP THICKNESS (mm) | VOLTAGE DIFFERENCE (volt) |
|---|---|---|
| pre-amplification | 3.5 | 800 |
| transfer 1 | 3.5 | 80 (gate open)<br>130 (gate closed) |
| transfer 2 | 3.5 | 80 (gate open)<br>−20 (gate closed) |
| transfer 3 | 3.5 | 80 (gate open)<br>130 (gate closed) |
| amplification: | | |
| first gap | 3.5 | 600 |

-continued

| STAGE | GAP THICKNESS (mm) | VOLTAGE DIFFERENCE (volt) |
|---|---|---|
| second gap | 3.5 | −600 |

A preferred level of potential for the photocathode 20 is 0 volts. In such a case, the preferred levels of potential for the respective electrodes 210, 212, 214, 220, 222 and 224 of each stage are:

gate open: 800 V, 880 V, 960 V, 1040 V, 1640 V, and 1040 V gate closed: 800 V, 930 V, 910 V, 1040 V, 1640 V, and 1040 V.

Any suitable method may be employed to read out the information from the electrode assemblies 220, 222 and 224 (or, alternatively, from assemblies 220 and 224 only). The readout electronics 116 of the present embodiment may be identical to readout electronics 116 of FIG. 1E. Appropriate connectors (not shown) are provided between the electrode assemblies and readout electronics 116. It is appreciated that, due to this arrangement, a separate readout electrode assembly need not be provided.

Electrode assemblies 220, 222 and 224 may be arranged such that the wires thereof define any desired angle between them. For example, the wires of assemblies 220 and 224 may be parallel to one another, whereas the wires of assembly 222 may be perpendicular to the wires of the other two.

The remainder of the apparatus is essentially identical to that described hereinabove in connection with FIG. 1A, and therefore, similar elements thereof are indicated by identical reference numerals.

Figure 2A:
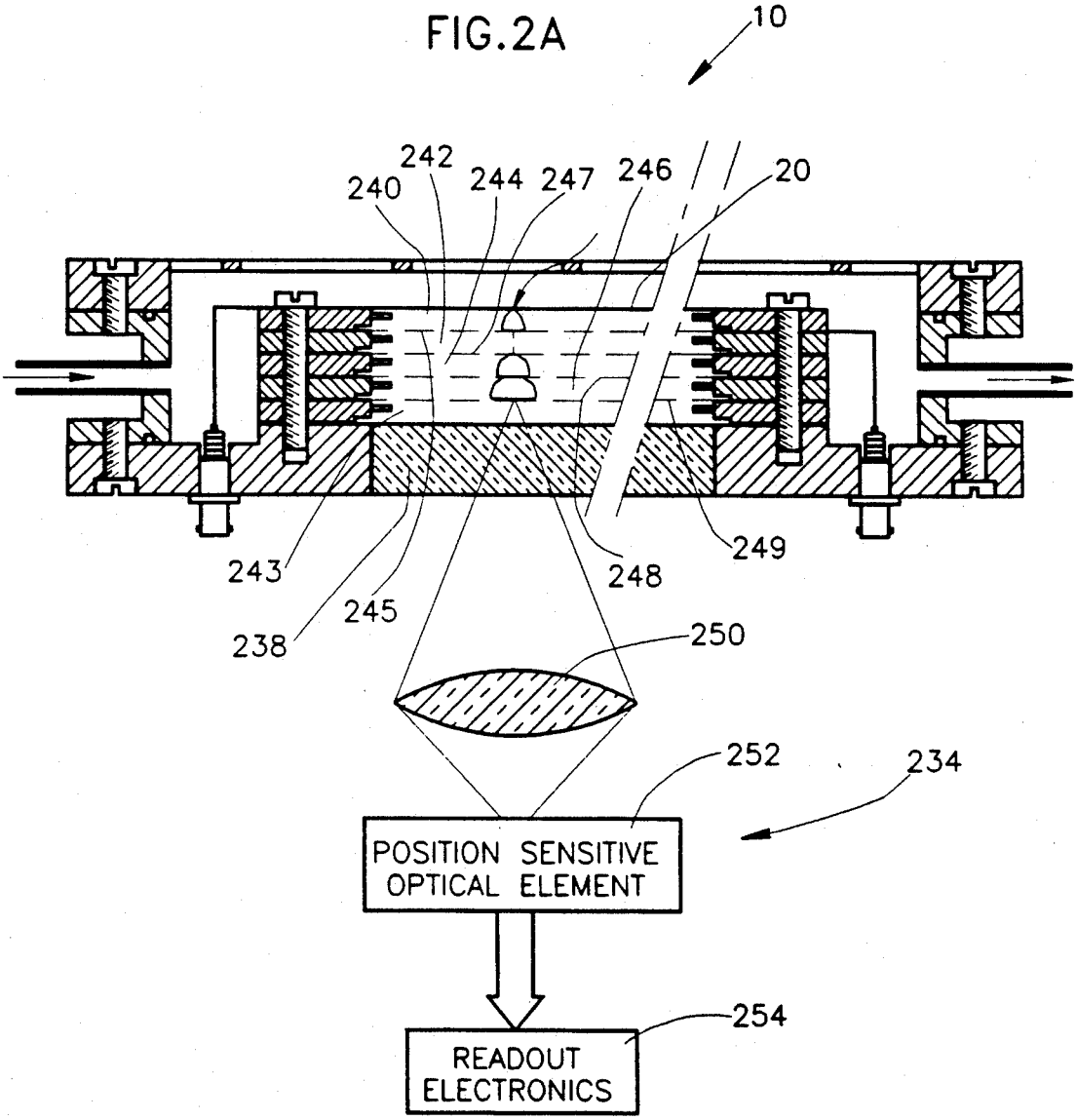
FIG. 2A is a schematic illustration of an X-ray photon detector combined with an optical sensor which is constructed and operative in accordance with a preferred embodiment of the present invention.
Figure 2B:
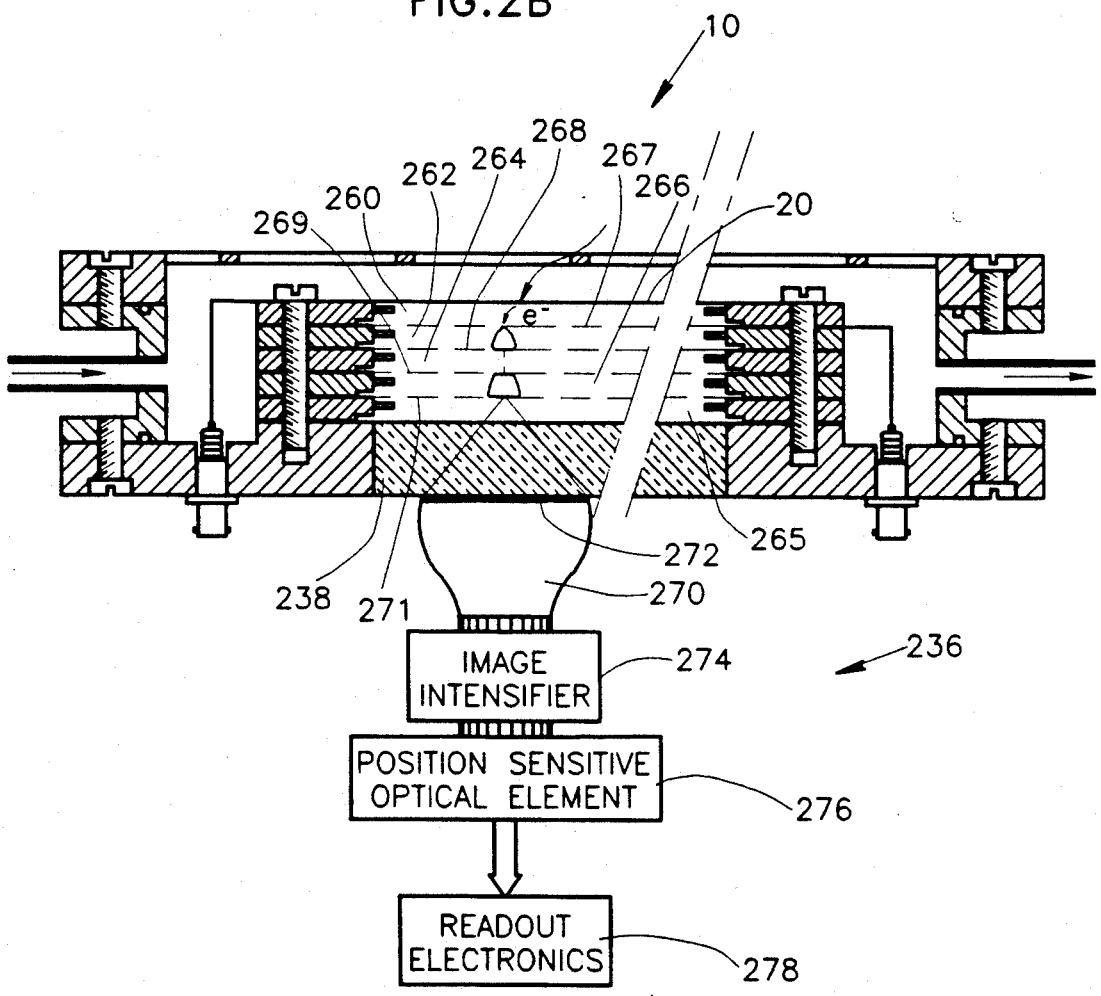
FIG. 2B is a schematic illustration of an X-ray photon detector combined with an optical sensor which is constructed and operative in accordance with another preferred embodiment of the present invention.

Reference is now made to FIGS. 2A–2B which illustrate an X-ray photon detector combined with an optical sensor constructed and operative in accordance with preferred embodiments of the present invention. The X-ray detector 10 may comprise any suitable X-ray detector such as those shown and described hereinabove with reference to FIGS. 1A–1I, but with the following exceptions:

A. The readout (referenced 40 in FIGS. 1A–1D and 116 in FIGS. 1E–1I) is here replaced by an optical readout system, referenced generally as 234 and 236 in FIGS. 2A and 2B respectively and described in detail hereinbelow; and B. There is provided an optical window 238 which is operative to extract the light from the electron and light multiplier 10. Any suitable commercially available UV transparent window 238 may be used, such as Quartz Suprasil-1 available from Heraeus, Hanau, West Germany. The thickness is determined as a function of the dimensions of the detector's active area. For example, if the active area is of dimensions $20\times20$ cm$^2$, the thickness of the optical window 238 should be approximately 15 mm.

C. The gas comprises any suitable light emitting gas or gas mixture which does not substantially inhibit electron avalanche such as the gas mixtures disclosed in D. Sauvage, A. Breskin & R. Chechik, "A systematic study of the emission of the light from electron avalanches in low pressure TEA and TMAE gas mixtures", Nucl. Instrum. Methods, A275, (1989), p. 351 onwards, and in A. Breskin et al., "A Three Stage Gated UV Photon Gaseous Detector With Optical Imaging", Nucl. Instrum. Methods A 286 (1990) p. 251 onwards, the disclosures of which are incorporated herein by reference. The gas pressure may be 20 Torr, as in previous embodiments.

The two documents incorporated by reference in the previous paragraph report results of operation of an avalanche gaseous amplification detector, containing a gas mixture comprising approximately 0.1–5 Torr of TMAE vapor or approximately 10–50 Torr of TEA vapor. These gas mixtures were found to emit light during the avalanche amplification process, as a result of the excitation of the gas molecules. The amount of light emitted was found to be directly proportional to and thus indicative of the number of electrons in the avalanche. Specifically, approximately 0.1 to 5 photons were found to be emitted per avalanche electron, depending on the particular composition of the gas and on the operation conditions of the amplification structure.

For example, using a gas mixture of 80% $C_2H_6$/20% Ar at 100 Torr, further comprising 5 Torr of TMAE, and using the apparatus of FIG. 2A, wherein the reduced electric field in the second amplification stage 246 is 20 V/cm Torr, the mean number of photons emitted per avalanche electron was found to be 1.5. When TEA gas mixtures were used, even higher mean values for the number of photons per avalanche electron, were found. Due to the above results, and since the light is emitted at the same location in space at which the charge is produced by the amplification process, localization and quantification of the light spot are equivalent to localization and quantification of the charge.

Referring now specifically to FIG. 2A, there is shown yet another type of electron multiplier having a preamplification stage 240, a transfer stage 242, and first and second amplification stages 244 and 246, and an insulative gap 243. The second amplification stage 246 acts as the main light amplifying element. The features of a typical light amplifying element are described in A. Breskin et al., "A highly efficient low pressure UV-RICH detector with optical avalanche recording," Nucl. Instrum. Methods A 273 (1988), p. 798 onwards, and in A. Breskin et al., "A Three Stage Gated UV Photon Gaseous Dectector With Optical Imaging", Nucl. Instrum. Methods A 286 (1990) P. 251 onwards, the disclosures of which are incorporated herein by reference.

The electrodes 245, 247, 248 and 249 defining the four stages referenced hereinabove, with the exception of photocathode 20, may be identical to electrode 52 of FIG. 1A, which is illustrated in detail in FIG. 3A.

Typical potentials across each stage and gap separations for each stage, for a gas pressure of 40 Torr are as follows:

| STAGE | GAP THICKNESS (mm) | VOLTAGE DIFFERENCE (volt) |
|---|---|---|
| pre-amplification | 3.5 | 1100 |
| transfer | 3.5 | 200 |
| amplification 1 | 3.5 | 1100 |
| amplification 2 | 3.5 | 500 |

A preferred level of potential for the photocathode 20 is 0 volts. In such a case, the preferred levels of potential for the respective electrodes 245, 247, 248 and 249 of each stage are:

1100 V, 1300 V, 2400 V, and 2900 V.

The optical system 234 recording the information from detector 10 comprises a UV transparent lens 250, such as a FLECTAN 75 Q, commercially available from NYE Optical Company, Spring Valley, Calif., USA. The image is transferred to a position sensitive optical element 252, such as an array of position sensitive photomultipliers, such as an XP 4702 photomultiplier with a sapphire window, commercially available from Phillips. The information from optical element 252 is received by readout electronics 254, such as that described by G. Comby et al., Nucl. Instrum. Methods A243 (1986) , p. 165–172, the disclosure of which is incorporated herein by reference.

The remainder of the apparatus is essentially identical to that described hereinabove in connection with FIG. 1A, and therefore, similar elements thereof are indicated by identical reference numerals.

Referring now specifically to FIG. 2B, there is shown yet another type of electron multiplier having a first transfer stage 260, a preamplification stage 262, a second transfer stage 264, an amplification stage 266 which acts as the main light amplifying element, and an insulative gap 265. The features of such a light amplifying element in the present embodiment.

The electrodes 267, 268, 269 and 271 defining the four stages referenced hereinabove, with the exception of photocathode 20, may be identical to electrode 52 of FIG. 1A, which is illustrated in detail in FIG. 3A.

Typical potentials across each stage and gap separations for each stage, for a gas pressure of 40 Torr are as follows:

| STAGE | GAP THICKNESS (mm) | VOLTAGE DIFFERENCE (volt) |
|---|---|---|
| transfer 1 | 3.5 | 200 |
| pre-amplification | 3.5 | 1100 |
| transfer 2 | 3.5 | 200 |
| amplification | 3.5 | 1100 |

A preferred level of potential for the photocathode 20 is 0 volts. In such a case, the preferred levels of potential for the respective electrodes 267, 268, 269 and 271 of each stage are:

200 V, 1300 V, 1500 V, and 2600 V.

The optical system 236 recording the information from detector 10 comprises an optical taper 270, such as the custom-made taper commercially available from Schott Fibre Optics Inc., Southbridge, Mass., USA, which is coupled to the optical window 238 via a wavelength shifter 272, such as p-terphenyl. The optical taper 270 is coupled to an image intensifier assembly 274, such as a BV 2562QX light amplifier coupled to a BV 1833 EG11 light amplifier, both commercially available from Proxitronic of Bensheim, W. Germany. Image intensifier 274 is coupled to a position sensitive optical element 276, such as a CCD camera, typically a 7864FO, commercially available from Thomson-France, which is read out by readout electronics 278, such as Thomson Driving Electronics Kit model TH 79K64 coupled to frame grabber and digitizer DT28581, commercially available from Data Translation of Marlboro, Mass., USA. The digitizer output may be supplied for frame analysis to a computer such as a PC/AT, used in conjunction with suitable software such as DT-IRIS, commercially available from Data Translation, Marlboro, Mass., USA. Alternatively, the position sensitive optical element 276 and the readout electronics 278 may be replaced by the position sensitive optical element 252 and the readout electronics 254, respectively, of FIG. 2A.

The remainder of the apparatus is essentially identical to that described hereinabove in connection with FIG. 1A, and therefore, similar elements thereof are indicated by identical reference numerals.

Figure 4B:
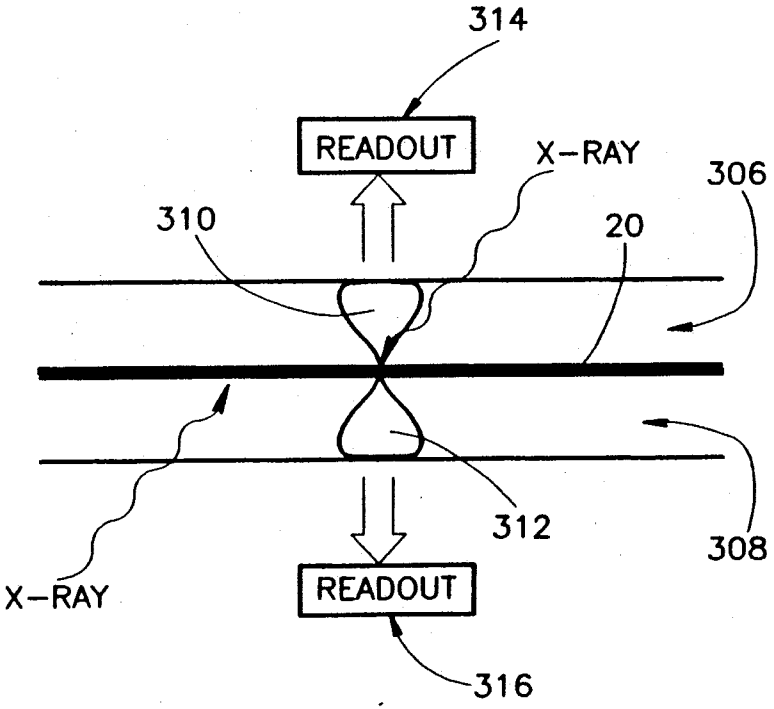
FIG. 4B is a schematic illustration of an alternative embodiment of X-ray photon detector which is capable of detecting photons from both sides of a planar photocathode.
Figure 4A:
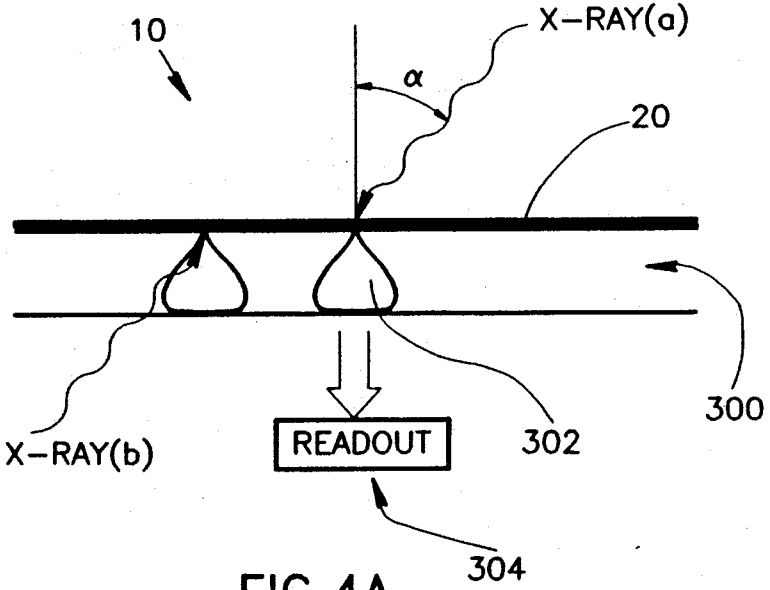
FIG. 4A is a schematic illustration of an X-ray photon detector which is capable of detecting photons impinging on both sides of a planar photocathode.

Reference is now made to FIGS. 4A and 4B, which illustrate X-ray detectors in which the photocathode is planar and is capable of receiving X-ray radiation impinging on either or both sides thereof, constructed and operative in accordance with alternative embodiments of the present invention. It is appreciated that the X-ray photons may impinge upon the photocathode 20 of the detector 10 at any desired angle alpha. Preferably, however, the angle alpha will be relatively large, i.e. in the range of approximately 80 to 90 degrees from the perpendicular, to enhance the detection efficiency.

Referring now to FIG. 4A, it is appreciated that X-ray photons may impinge upon the photocathode 20, associated with electron multiplier 300 disposed downstream thereof, from either the upstream side or the downstream side thereof. In FIG. 4A, X-ray photon beam (a) is shown impinging upon the upstream side of the photocathode, whereas the X-ray photon beam (b) is shown impinging upon the downstream side thereof. Electron multiplier 300 creates an electron avalanche 302, read out by a readout system 304, as shown.

Figure 6A:
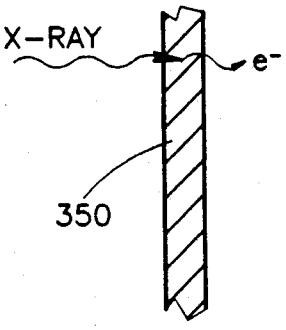

Reference is now made to FIG. 4B, which shows that two electron multipliers 306 and 308 may be provided on both respective sides of photocathode 20, which in this embodiment comprises a double side photocathode 20 such as the photocathode assemblies shown in FIGS. 6A and 6G. Electron multipliers 306 and 308 each create an electron avalanche, referenced 310 and 312 respectively, amplifying electrons from the photocathode 20. Electron multipliers 306 and 308 are preferably read out separately by readout systems 314 and 316, respectively, as shown. As in FIG. 4A, the X-ray photons may impinge upon the photocathode 20 from either side thereof.

Figure 5:
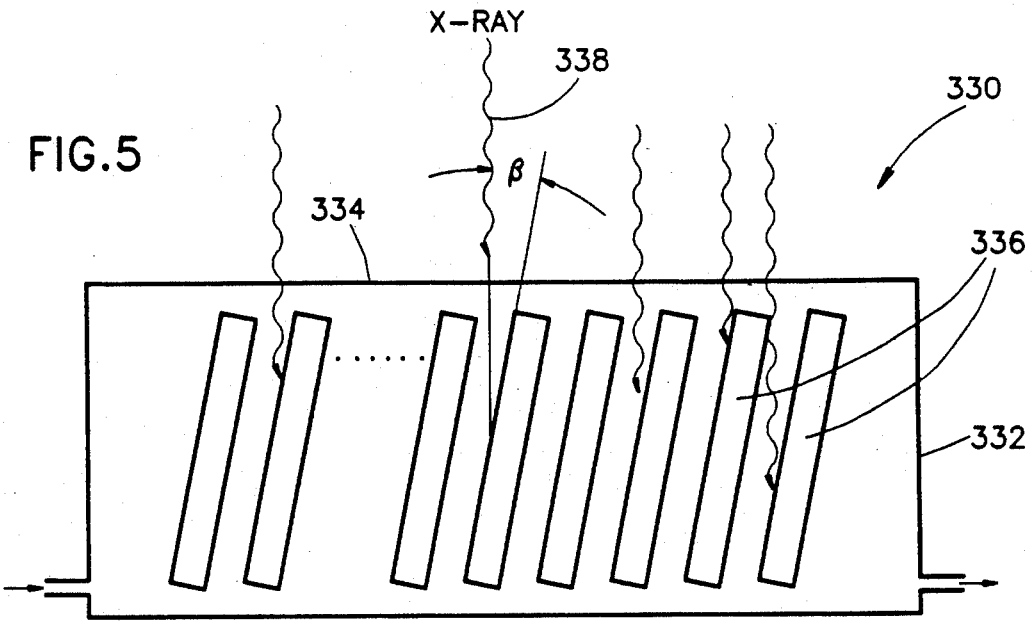
FIG. 5 is a schematic illustration of an X-ray photon detector assembly comprising a plurality of stacked X-ray photon detector modules.

Reference is now made to FIG. 5, which illustrates an X-ray detector assembly, indicated generally by reference numeral 330, which is constructed and operative in accordance with yet another preferred embodiment of the present invention. Assembly 330 comprises a low-pressure gas filled enclosure 332 including an entrance window 334, typically formed of polypropylene supported on a frame (not shown), similar to the window 14 and frame 16 shown and described with reference to FIG. 1A. However, the assembly 330 comprises a plurality of stacked X-ray detector modules 336, rather than a single such module as in the embodiments of FIG. 1A–1I. Each module may comprise an electron multiplier identical to the various embodiments thereof disclosed with reference to FIGS. 1A–1I. According to a preferred embodiment, the modules are arranged in a generally mutually parallel orientation which is at an angle beta of typically 1 to 10 degrees from the X-ray beam impingement direction 338. It is noted that individual windows need not be provided for each individual module 336. Rather, the entire enclosure 332 is a single gas filled enclosure.

Reference is now made to FIGS. 6A–6G, which illustrate alternative embodiments of photocathode assemblies useful in the present invention. Referring specifically to FIG. 6A, there is shown a photocathode comprising a metal foil 350 which may be formed of any suitable conducting material such as tantalum, gold, platinum, aluminum, or tungsten, of a thickness depending on the energy of impinging photons. For example, for a gold layer 350 and an X-ray energy of 10 KeV, a typical thickness is approximately 5 microns. For an X-ray energy of 80 KeV, a typical thickness is approximately 15 microns.

Figure 6B:
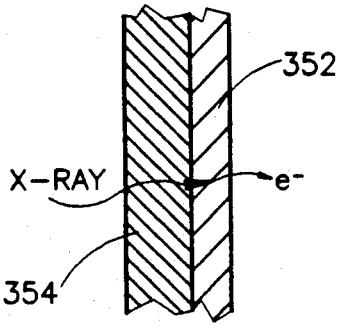

FIG. 6B shows a photocathode assembly comprising a thin semiconductive or metal photocathode layer 352 deposited upon an insulative support foil layer 354. Thin layer 352 may be formed of any suitable semiconductive or conducting material such as CuI or gold, of a suitable thickness which depends on the energy of the impinging photons. For example, for a CuI layer 352 and an X-ray energy of 10 KeV, a typical thickness is approximately 1 micron. If the X-ray energy is 80 KeV, a typical thickness is approximately 30 microns. The insulative support foil layer 354 may be formed of any suitable electrically insulative, low X-ray absorbing material such as polypropylene, Parylene M, Kapton, Mylar, Aclar or Nylon, of suitable thickness. For example, for an X-ray energy of 10 KeV, a typical thickness is in the range of 5–50 microns.

Figure 6C:
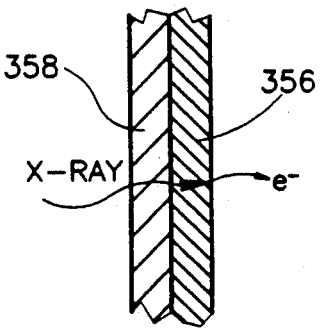

FIG. 6C shows a photocathode assembly comprising a nonconductive (insulating or semi-conducting) photocathode layer 356 deposited upon a thin metal support layer 358. Photocathode layer 356 may be formed of any suitable nonconductive material such as CsI or CuI of a suitable thickness which depends on the energy of impinging photons. For example, for a CsI photocathode layer 356 and an X-ray energy of 10 KeV, a typical thickness is approximately 1.5 microns. For an X-ray energy of 80 KeV, a typical thickness is approximately 45 microns. The support layer 358 may be formed of any suitable metal such as aluminum, gold or copper, of suitable thickness. For example, for a gold layer 358 and an X-ray energy of 10 KeV, a typical thickness is 5–10 microns.

Figure 6D:
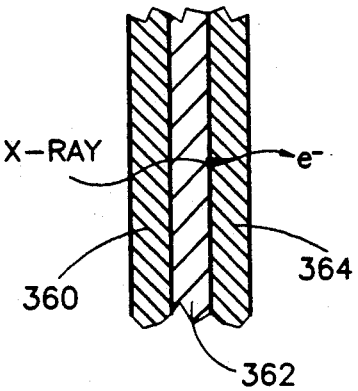

FIG. 6D shows a photocathode assembly comprising a thin insulative support layer 360 followed by a thin conductive layer 362 and a nonconductive photocathode layer 364. Support layer 360 may be identical to support layer 354 of FIG. 6B. Conductive layer 362 may be formed of any suitable material such as aluminum, gold or Nichrome of suitable thickness. For example, a gold layer 362 is typically approximately 1 micron thick. Photocathode layer 364 may be identical to photocathode layer 356 of FIG. 6C.

Figure 6E:
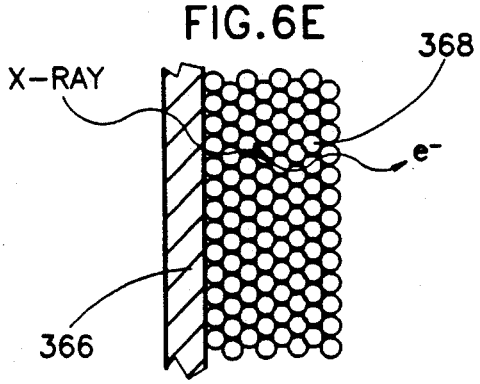

FIG. 6E shows a photocathode assembly comprising a metal support layer 366 followed by a low density nonconductive photocathode layer 368. Metal support layer 366 may be identical to support layer 358 of FIG. 6C. Photocathode layer 368 may be formed of a layer of fluffy (low density) CsI, typically with a density of approximately 1–3% of the bulk density of CsI and being of a suitable thickness. For example, for an X-ray energy of 5 KeV, a typical thickness is in the range of 1000 micrograms/cm$^2$. Details of a preferred material suitable for photocathode layer 368 are provided in C. Chianelli et al., Nucl. Instrum. Methods A 273 (1988) p. 245–256, and in "Quantum Efficiency of Cesium Iodide Photocathodes at Soft X-ray and Extreme Ultraviolet Wavelengths", by M. P. Kowalski et al, Applied Optics Vol. 25, No. 14 (Jul. 15, 1986), pages 2440–2446, the disclosures of which documents are incorporated herein by reference.

FIG. 6F shows a photocathode assembly comprising a support layer 370 followed by a nonconductive photocathode layer 372 and a thin metal layer 374. Support layer 370 may be identical to support layer 358 of FIG. 6C. The photocathode layer 372 may be identical to photocathode layer 356 of FIG. 6C. The thin metal layer 374 may be formed of any suitable material such as Nichrome, Aluminum, or Gold having a thickness of 0.05–1 micron.

FIG. 6G shows a photocathode assembly 376 corresponding to the photocathode assembly of FIG. 6D but being double-sided. It is appreciated that any of the photocathode assemblies of FIGS. 6B–6F may similarly be provided in double-sided form. Photocathode assembly 376 comprises a thin insulative support layer 380 sandwiched between a first thin conductive layer 382 followed by a nonconductive photocathode layer 384, on one side, and a second thin conductive layer 386 followed by a second photocathode layer 388, on the other side. Thin insulative support layer 380 may be identical to support layer 360 of FIG. 6D. First and second thin conductive layers 382 and 386 may be identical to conductive layer 362 of FIG. 6D. Photocathode layers 384 and 388 may be identical to photocathode layer 364 of FIG. 6D.

The photocathode assembly in FIG. 6A is particularly useful in high energy X-ray applications (in the range of approximately 50–500 KeV). The photocathode assemblies in FIGS. 6B–6D and 6F–6G are particularly useful in the low and medium energy range (approximately 6–50 KeV). The photocathode assembly in FIG. 6E is particularly useful in the very low energy range (approximately 0.1–6 KeV).

It is noted that the features shown and described in connection with various drawings, such as the presence of a gate, the presence of a resistive layer, the type of readout electrode, and the choice of readout method may be combined in any suitable combination in accordance with the present invention.

The results of an experiment demonstrating the efficiency of the X-ray detection apparatus shown and described herein, relative to state of the art X-ray detectors are now described.

In the experiment, performance of an X-ray detector constructed and operative in accordance with the present disclosure and including the preferred embodiment of photocathode shown and described above with reference to FIG. 6C was compared to the performance of an X-ray detector which was identical except that the photocathode was as shown and described above with reference to FIG. 6A.

Figure 7A:
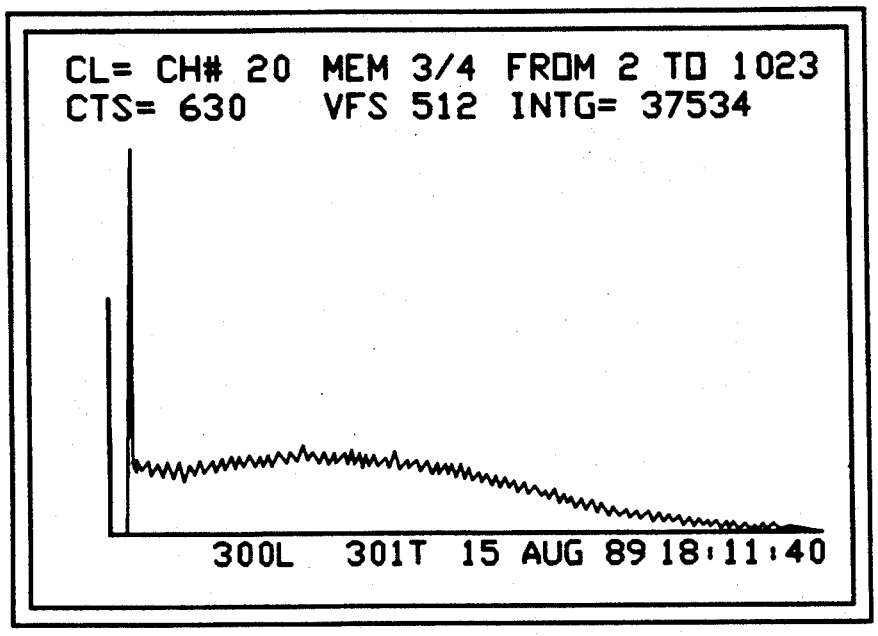
FIGS. 7A-7B illustrate results of an experiment demonstrating the relative efficiencies of X ray detection apparatus respectively including the photocathodes of FIGS. 6A and 6C.
Figure 7B:
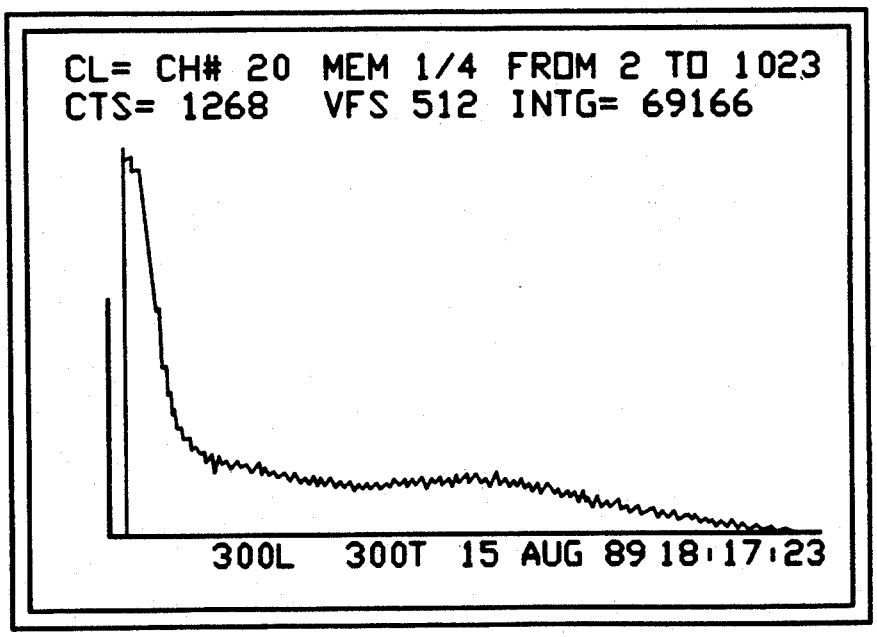

The performance of the detector including the photocathode of FIG. 6A is seen in FIG. 7A. The performance of the detector including the photocathode of FIG. 6C is seen in FIG. 7B. As is obvious from a comparison of the two figures, the quantum efficiency of the photocathode of FIG. 6C considerably exceeds the quantum efficiency of the photocathode of FIG. 6A. Specifically, it was found that when the photocathode of FIG. 6C was employed, substantially all (100%) absorbed X-ray photons were detected by the device.

Also, the timing response of an X-ray detector including the photocathode of FIG. 6C was measured using a UV radiation source rather than an X-ray radiation source. The timing was found to be approximately 4 nanoseconds for a single electron event and less than one nanosecond for a multielectron event. It is believed that this result is approximately 100 times superior to results obtained using state of the art X ray detectors. For example, fast scintillators have timing of a few microseconds.

Results of an experiment demonstrating the relatively high detection resolution achieved by the apparatus shown and described herein are reported in the following publication, the disclosure of which is incorporated herein by reference:

"High Accuracy Imaging of Single Photoelectrons by Low-Pressure Multistep Avalanche Chamber Coupled to a Solid Photocathode" by A. Breskin and R. Chechik, Nuclear Instruments and Methods in Physics Research 227, (1984) 24–28.

In this experiment, the detection resolution was found to be of the order of 0.2 mm.

It is appreciated that the X-ray detection apparatus and methods shown and described hereinabove are general and have a very broad range of applications. A medical radiography application is now discussed, it being appreciated that this application is intended to be merely exemplary of the possible applications and is not intended to be limiting.

The above description is applicable to an X-ray medical diagnostic method including the steps of:

radiating a subject to be diagnosed with X-ray radiation; and employing an X-ray detector of the type shown and described above in order to perform radiography by detecting the X-ray radiation.

For medical applications, a crucial consideration is to minimalize the dosage of radiation. Therefore, it is believed that a preferred embodiment of X-ray detector employed for medical purposes is one which is sensitive to a relatively small amount of radiation, such as the embodiments of FIG. 4B or 5. It is believed to be most preferable to employ an embodiment of X-ray detector which combines the double-sided characteristic of the embodiment of FIG. 4B with the relatively small angle between the photocathode surface and the direction of radiation provided in the embodiment of FIG. 5.

The disclosure of the present invention is also believed to have industrial applications in monitoring and controlling dynamic industrial processes such as lubrication of mechanical parts and flows of fluids through mechanical systems. The disclosure of the present invention is also believed to be applicable to screening of static objects such as screening of luggage at air facilities to detect weapons and narcotics. As described above, a particular feature of the apparatus and methods of X-ray detection disclosed herein is the relatively high detection resolution achieved thereby. This feature is particularly important in industrial and security applications.

It will be appreciated by persons skilled in the art that the present invention is not limited by what has been particularly shown and described above. The scope of the present invention is defined only by the claims which follow:

We claim:

1. An X-ray detector comprising:

a photocathode for receiving X-ray radiation and being operative to provide in response thereto an output of electrons; and integrally formed therewith at least one gaseous electron multiplier having a gas and operative in response to the output of electrons from the photocathode to provide an avalanche comprising an increased number of electrons, and wherein said at least one electron multiplier includes a preamplification stage and said photocathode constitutes a cathode of said preamplification stage.

2. Apparatus according to claim 1 and wherein said at least one electron multiplier comprises a multistage electron multiplier.

3. An X-ray detector according to claim 1 and also comprising at least one detecting means for detecting an indication of at least one characteristic of the electron avalanche produced by the electron multiplier.

4. An X-ray detector according to claim 2 and also comprising at least one detecting means for detecting an indication of at least one characteristic of the electron avalanche produced by the electron multiplier.

5. An X-ray detector according to claim 1 and wherein the at least one electron multiplier comprises at least one detecting means for detecting an indication of at least one characteristic of the electron avalanche produced by the electron multiplier.

6. An X-ray detector according to claim 2 and wherein the at least one electron multiplier comprises at least one detecting means for detecting an indication of at least one characteristic of the electron avalanche produced by the electron multiplier.

7. An X-ray detector according to claim 1 and wherein said electron multiplier includes at least the following stages:

at least one amplification stage; and at least one transfer stage.

8. An X-ray detector according to claim 2 and wherein said electron multiplier includes at least the following stages:

at least one amplification stage; and at least one transfer stage.

9. An X-ray detector according to claim 5 and wherein said detecting means comprises electron detection means for detecting the electrons produced by the electron avalanche.

10. An X-ray detector according to claim 9 and wherein said electron detection means comprises a plurality of pad electrode assemblies for collecting the electrons produced by the electron multiplier.

11. An X-ray detector according to claim 10 and wherein each of the pad electrode assemblies comprises:

a pad electrode;

an insulative layer; and a resistive layer.

12. An X-ray detector according to claim 9 and wherein said electron detection means comprises at least one strip electrode array, said strip electrode array comprising:

a first plurality of mutually parallel strip electrodes;

generally planar insulating means, defining a plane generally parallel to said first plurality of mutually parallel strip electrodes; and a second plurality of mutually parallel strip electrodes, arranged generally parallel to the plane and generally perpendicular to the first plurality of strip electrodes.

13. An X-ray detector according to claim 1 wherein the photocathode is generally planar and is configured and arranged to receive X-ray radiation impinging on both sides thereof and wherein the at least one electron multiplier comprises two electron multipliers disposed respectively on the two sides of the planar photocathode.

14. An X-ray detector according to claim 2 wherein the photocathode is generally planar and is configured and arranged to receive X-ray radiation impinging on both sides thereof and wherein the at least one electron multiplier comprises two electron multipliers disposed respectively on the two sides of the planar photocathode.

15. An X-ray detector according to claim 3 and wherein said detecting means comprises photon detection means for detecting photons emitted during the electron avalanche.

16. An X-ray detector assembly comprising:

a gas filled enclosure; and a plurality of X-ray detectors located interiorly of the gas filled enclosure, each individual one of the plurality of X-ray detectors being according to claim 1.

17. An X-ray detector assembly comprising:

a gas filled enclosure; and a plurality of X-ray detectors located interiorly of the gas filled enclosure, each individual one of the plurality of X-ray detectors being according to claim 2.

18. An X-ray detecting method comprising the steps of:

providing a photocathode in a gas at a sub-atmospheric pressure for receiving and detecting X-ray radiation and being operative to provide in response thereto an output of electrons in an avalanche comprising an increased number of electrons.

19. An X-ray medical diagnostic method comprising the steps of:

radiating a subject to be diagnosed with X-ray radiation; and employing an X-ray detector according to claim 1 in order to perform radiography by detecting said X-ray radiation.

20. An X-ray medical diagnostic method comprising the steps of:

radiating a subject to be diagnosed with X-ray radiation; and employing an X-ray detector according to claim 2 in order to perform radiography by detecting said X-ray radiation.

21. An X-ray detector comprising:

at least one gaseous electron multiplier including a first stage having a cathode, said cathode comprising a photocathode for receiving X-ray radiation and being operative to provide in response thereto an output of electrons, said at least one gaseous electron multiplier having a gas and being operative in response to the output of electrons from the photocathode to provide an avalanche comprising an increased number of electrons.

* * * * *